US011825998B2

(12) United States Patent
Lutz et al.

(10) Patent No.: US 11,825,998 B2
(45) Date of Patent: Nov. 28, 2023

(54) DOMESTIC DISHWASHER AND METHOD FOR TREATING ITEMS TO BE WASHED

(71) Applicant: BSH Hausgeräte GmbH, Munich (DE)

(72) Inventors: Stephan Lutz, Zusamaltheim (DE); Michael Georg Rosenbauer, Reimlingen (DE); Norbert Gerstner, Herbrechtingen (DE); Alexander Almus, Bissingen (DE); Thomas Burggraf, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 591 days.

(21) Appl. No.: 16/619,104

(22) PCT Filed: Jul. 4, 2018

(86) PCT No.: PCT/EP2018/068119
§ 371 (c)(1),
(2) Date: Dec. 4, 2019

(87) PCT Pub. No.: WO2019/015967
PCT Pub. Date: Jan. 24, 2019

(65) Prior Publication Data

US 2020/0093346 A1 Mar. 26, 2020

(30) Foreign Application Priority Data

Jul. 18, 2017 (DE) ..... 10 2017 212 300.1
Dec. 19, 2017 (DE) ..... 10 2017 223 255.2

(51) Int. Cl.
*A47L 15/00* (2006.01)
*A47L 15/42* (2006.01)
*A47L 15/48* (2006.01)

(52) U.S. Cl.
CPC ..... *A47L 15/0013* (2013.01); *A47L 15/0034* (2013.01); *A47L 15/4246* (2013.01);
(Continued)

(58) Field of Classification Search
CPC .. A47L 15/0013; A47L 15/0034; A47L 15/48; A47L 15/486
See application file for complete search history.

(56) References Cited

U.S. PATENT DOCUMENTS 2,715,407 A 8/1955 Wright
3,513,567 A 5/1970 Paul
(Continued)

FOREIGN PATENT DOCUMENTS

CN 105593525 A 5/2016
CN 106388743 A 2/2017
(Continued)

OTHER PUBLICATIONS

DE532341—Machine Translation (Year: 1931).*
(Continued)

*Primary Examiner* — Marc Lorenzi
(74) *Attorney, Agent, or Firm* — Michael E. Tschupp; Andre Pallapies; Brandon G. Braun

(57) ABSTRACT

A household dishwasher includes a dishwasher cavity defining a treatment chamber, a loading unit accommodated in the treatment chamber for holding items to be washed, a washing apparatus configured to apply washing liquid to the treatment chamber, and a fan wheel mounted in the treatment chamber above the loading unit for rotation in a blow-off operating phase such that the fan wheel draws in air from the treatment chamber, accelerates and moves the air forward and downward as an air flow in the treatment chamber. The air flow strikes a blow-off region at a top of the loading unit and blowing off washing liquid from atop the items being washed.

14 Claims, 12 Drawing Sheets

(52) U.S. Cl.
CPC ..... *A47L 15/4274* (2013.01); *A47L 15/486* (2013.01); *A47L 15/488* (2013.01)

(56) References Cited

U.S. PATENT DOCUMENTS

| | | | | |
|---|---|---|---|---|
| 6,053,185 | A | 4/2000 | Beevers | |
| 2008/0264458 | A1* | 10/2008 | Berner | A47L 15/483 134/57 D |
| 2009/0114252 | A1* | 5/2009 | Robert | F26B 9/06 134/25.1 |
| 2009/0158928 | A1* | 6/2009 | Wu | A47L 15/481 96/144 |
| 2011/0120510 | A1 | 5/2011 | Delle | |
| 2011/0155185 | A1 | 6/2011 | Kim et al. | |
| 2013/0180553 | A1* | 7/2013 | Gaus | B08B 3/04 134/105 |
| 2014/0170954 | A1* | 6/2014 | Hintz | A47L 15/488 454/251 |
| 2016/0113478 | A1 | 4/2016 | Disch | |
| 2017/0202423 | A1* | 7/2017 | Kumar | A47L 15/0042 |
| 2017/0311771 | A1* | 11/2017 | Lutz | A47L 15/481 |

FOREIGN PATENT DOCUMENTS

| | | | | |
|---|---|---|---|---|
| CN | 107260098 | A * | 10/2017 | A47L 15/22 |
| DE | 532341 | A1 | 8/1931 | |
| DE | 532341 | C * | 8/1931 | A47L 15/48 |
| DE | 102015013364 | A1 | 4/2017 | |
| FR | 2649001 | A1 | 1/1991 | |
| GB | 1530734 | | 11/1978 | |
| WO | 2013090155 | A1 | 6/2013 | |
| WO | WO-2016071154 | A1 * | 5/2016 | A47L 15/0013 |

OTHER PUBLICATIONS

CN107260098—Machine Translation (Year: 2017).*
International Search Report PC/EP2018/068119 dated Sep. 6, 2018.
National Search Report CN 2018800479154 dated Jul. 20, 2022.

* cited by examiner

DOMESTIC DISHWASHER AND METHOD FOR TREATING ITEMS TO BE WASHED

CROSS-REFERENCES TO RELATED APPLICATIONS

This application is the U.S. National Stage of International Application No. PCT/EP2018/068119, filed Jul. 4, 2018, which designated the United States and has been published as International Publication No. WO 2019/015967 A1 and which claims the priorities of German Patent Applications, Serial No. 10 2017 212 300.1, filed Jul. 18, 2017 and Serial No. 10 2017 223 255.2, filed Dec. 19, 2017, pursuant to 35 U.S.C. 119(a)-(d).

BACKGROUND OF THE INVENTION

The invention relates to a household dishwasher with a dishwasher cavity, in the treatment chamber of which at least one loading unit for holding items to be washed is accommodated, and with at least one washing apparatus for applying washing liquid to the treatment chamber.

During the course of a selected dishwashing program a household dishwasher generally performs one or more liquid-conducting washing sub-cycles, such as a pre-rinse cycle, cleaning cycle, intermediate rinse cycle, final rinse cycle and then a drying cycle to terminate the washing cycle. During the respective liquid-conducting washing sub-cycle washing liquid is distributed, in particular sprayed, by means of at least one washing apparatus, such as for example a rotating spray arm, a fixed spray nozzle, for example a top spray head, a movable spray nozzle, for example a top spinning unit, and/or some other liquid distribution apparatus, in the treatment chamber of the dishwasher cavity of the household dishwasher, in which process it is applied to items to be washed, such as dishes and/or cutlery, to be cleaned, which are supported in and/or on at least one loading unit, for example a pull-out rack or a cutlery drawer that can preferably be removed or pulled out. To this end the respective washing apparatus is preferably supplied with washing liquid by way of at least one supply line by an operating circulating pump, said washing liquid collecting at the bottom of the dishwasher cavity, preferably in a depression, in particular in a sump. If the washing liquid has to be heated during the respective liquid-conducting washing sub-cycle, the washing liquid is heated by means of a heating facility. This can be part of the circulating pump. At the end of the respective liquid-conducting washing sub-cycle some or all of the washing liquid present in the treatment chamber of the dishwasher cavity in each instance is pumped out by means of a drain pump.

A plurality of different drying systems with associated drying methods are available for drying items being washed that have been washed clean and made wet in this manner at the end of a washing cycle. These include in particular what is referred to as residual heat drying, condensation drying (in particular for example by means of heat exchangers on a side wall of the dishwasher cavity for cooling purposes), drying by opening a door at the end of the drying cycle, convection drying with the aid of a blower, sorption drying using zeolite for example, etc. These are intended to dry off liquid droplets still adhering to the respective items being washed after the liquid distribution operation in the last liquid-conducting washing sub-cycle of a dishwashing program to be performed during the drying cycle.

However if washing liquid collects in an uppermost depression, e.g. well, hollow, groove or other cavity, in an item being washed during the one or more liquid-conducting washing sub-cycles of a washing program to be performed preceding the drying cycle and a quantity of washing liquid remains on the top there at the end of the liquid distribution operation or washing operation of the liquid-conducting washing sub-cycle of the dishwashing program preceding the drying cycle, this remaining quantity of liquid is often too great to be dried off by a conventional drying system. This remaining residual liquid can generally only be removed by the user at the end of the drying cycle by tipping the respective item being washed manually and/or using a dish towel to dry by hand, which is inconvenient and time-consuming. Also such puddles in uppermost depressions in items being washed after the drying cycle can result in unsightly, persistent deposits or stains, as the remaining washing liquid contains dirt particles, cleaning agents, rinse aid, lime and/or other additions, which remain as solid residues in the respective depression after the partial or complete drying of the puddles.

To remedy this, U.S. Pat. No. 6,053,185 proposes a dishwasher with a compressed air injection system. It comprises a compressed air distributor with a plurality of fixed nozzle ducts, which are positioned on the top wall of the interior of the dishwasher cavity of said dishwasher, being evenly distributed thereon. The nozzle ducts provide a large number of individual nozzles taken as a whole, said individual nozzles pointing downward. Short jets of compressed air, in other words focused jets of compressed air, can be expelled downward out of said nozzles onto assigned points in the upper rack, which is arranged below the compressed air distributor, during the drying cycle of a dishwashing program. Compressed air from an air compression tank, which is accommodated in the base or pedestal of the dishwasher below the dishwasher cavity, is supplied to the compressed air distributor from outside by way of a supply line in this process. A compressor is also provided to fill the compressed air tank with compressed air.

DE 10 2015 013 364 A1 provides a pre-drying facility within a housing of a dishwasher in addition to a cleaning apparatus and a drying apparatus. The pre-drying facility comprises at least one blower nozzle that can be directed onto the respective dish, applying a jet of air to the dish, to remove washing liquid remaining after the cleaning cycle from its uppermost depression.

BRIEF SUMMARY OF THE INVENTION

It is the object of the invention to provide a household dishwasher with an alternative option for largely removing a quantity of liquid present at the top of the respective item being washed, which is supported in/or on a loading unit in the treatment chamber of the dishwasher cavity, in particular liquid that has collected in an uppermost depression, e.g. well, hollow, groove or other cavity, in the respective item being washed.

This object is achieved in a household dishwasher of the type mentioned in the introduction in that one or more fan wheels that can be driven in a rotating manner are provided in the treatment chamber above the loading unit, in particular an upper rack, and the respective fan wheel is driven in a rotating manner in at least one blow-off operating phase such that it draws in air from the treatment chamber, accelerates it and moves it forward and downward as an air flow in the treatment chamber, said air flow striking a large blow-off region at the top of the loading unit arranged below the fan wheel and largely blowing off quantities of liquid present on the tops of items being washed that are supported there.

Therefore compared with the individual air nozzles in U.S. Pat. No. 6,053,185 and DE 10 2015 013364 A1 the inventive household dishwasher provides an alternative apparatus, which can be used largely to eliminate quantities of liquid present from the tops of items being washed that are positioned in and/or on a loading unit, in particular quantities of collected liquid remaining in uppermost depressions in the items being washed, in a simple and rapid manner.

In the inventively structured household dishwasher one or more fan wheels are accommodated in the treatment chamber of the dishwasher cavity, drawing in the air present in the treatment chamber of the dishwasher cavity, in other words the inner air in the treatment chamber of the dishwasher cavity, directly for a desired blow-off operating phase and accelerating it actively so that it is given a flow impetus, which is sufficient largely to blow off a quantity of liquid present on the top of the respective item being washed, in particular liquid that has collected in an uppermost depression in the respective item being washed. Blowing off liquid from the respective item being washed in this manner simply by accelerating the air already present in the treatment chamber is advantageously in particular simple, rapid and efficient.

Because with the inventive household dishwasher only the air in the treatment chamber is accelerated by one or more fan wheels, which are accommodated in the treatment chamber of the dishwasher cavity and can be driven in a rotating manner, during rotation operation during a blow-off operating phase and subjected to a speed component, which is sufficient to give the air flow generated such a significant flow impetus that quantities of liquid, which are present on the tops of items being washed, in particular in uppermost depressions in items being washed, can be blown down, further components—for example a compressor, air compression tank, compressed air line from air compression tank to nozzle distributor as in U.S. Pat. No. 6,053,185—are not required. The one or more fan wheels that can be driven in a rotating manner can be accommodated in a structurally simple manner in the treatment chamber of the dishwasher cavity, favoring the mass production of millions of household dishwashers. A compressed air supply from outside as in U.S. Pat. No. 6,053,185 is not provided or necessary. There are therefore no pressure losses, as can be associated with the compressor and compressed air container accommodated in the pedestal of the dishwasher in U.S. Pat. No. 6,053,185 and the long compressed air upward conduction line. Also compared with the dishwasher with the compressed air injection system in U.S. Pat. No. 6,053,185, there is largely no possibility of the compressed air supplied from outside by way of the individual nozzles during the drying phase of a dishwashing program changing the pressure conditions and/or air, moisture and/or steam composition in the dishwasher cavity treatment chamber, which could result in modifications to the structure of household dishwashers of conventional design and/or changes to the nature and/or mode of performance of their dishwashing programs. In some instances the supply of compressed air from outside could require restructuring of the expansion valve or the door closing system of the dishwasher, for example to prevent the door being opened in an unwanted manner due to excessive pressure forces, which could be produced by the air supplied from outside in the treatment chamber. In contrast, with the invention, the same basic type of household dishwasher can easily be fitted with and without fan wheel(s) ex works. This simplifies the mass production of different variants of household dishwasher. Also a household dishwasher can easily be retrofitted with one or more fan wheels, as its treatment chamber can be accessed easily by opening its door. Also no additional space is required in the pedestal of the household dishwasher for a compressor and the compressed air tank as in U.S. Pat. No. 6,053,185.

Also in practice the one or more fan wheels accommodated in the wash chamber or treatment chamber are less susceptible to dirt, for example food residues, grease, etc. and/or washing liquid, in particular washing liquor, than the air nozzles in U.S. Pat. No. 6,053,185 and DE 10 2015 013364 A1. While the air nozzles and their associated compressed air lines or compressed air ducts can be blocked by dirt particles, food residues, cleaning agents, lime, etc. and/or filled with washing liquid during the washing operation of a dishwasher, thereby restricting their functionality or rendering them unusable for a desired blow-off operating phase, because the free expulsion of compressed air jets is impeded, the respective fan wheel in the treatment chamber of the inventive household dishwasher can always be driven in a rotating manner and therefore remains functional for the service life of said household dishwasher.

In the inventive household dishwasher, a single fan wheel or multiple fan wheels is/are arranged above the loading unit to be subjected to a flow in each instance, in particular an upper rack, in the treatment chamber or wash chamber. The respective fan wheel generates an air flow or wind in a downward direction onto the items being washed supported below it and/or in the loading unit from the air in the treatment chamber during a blow-off operating phase. As the air flow generated by the respective fan wheel flows essentially on a direct path, in other words largely unobstructed, to the respective item being washed below it and/or on the loading unit, it strikes the quantity of liquid on top of the respective item being washed—for example in an uppermost depression in the item being washed—with its flow impetus from the fan wheel largely unattenuated and pushes it off or blows it off, so it runs down to the bottom of the dishwasher cavity. There are few or no obstructions in the way of the air flow generated by the respective fan wheel during its rotation operation on its path to the top of the respective item being washed due to adjacent items being washed, with such continued movement of the air flow with a direction of advance from top to bottom, in other words from a region of the treatment chamber in which the respective fan wheel is provided and which is above the loading unit to be blown, downward onto the items being washed supported in and/or on the loading unit. The air flow generated in a downward direction by the respective fan wheel, which is large, in other words extended or extensive, when viewed in cross section (in a sectional plane perpendicular to the air flow direction) can strike the top of the respective item being washed regardless of its location and press or push, in other words blow, in particular any washing liquid present in a depression out of said depression. Such blowing of liquid out of an uppermost depression in the respective item being washed is successful even if there are items of differing heights in and/or on the loading unit, as the air flow moving forward from top to bottom can reach the tops of the items being washed largely unimpeded or largely without obstruction on the direct air path.

Within the context of the invention direction and/or spatial details such as top, bottom, side, front, rear, vertical, horizontal, etc. as well as terms with directional dependence and/or spatial reference such as front face, rear face, side wall, bottom, top, etc., are to be understood as being from the point of view of a user standing in front of the household dishwasher and operating and using it in the correct manner. Said user looks from his/her position toward the front, in particular the front door, of the household dishwasher, when the front door is in its closed end position. When the front door is completely open, for example to unload or load the wash chamber or treatment chamber and thereby preferably in an approximately horizontal position, the user looks into the treatment chamber or wash chamber in the depthwise direction. "Top" refers to a position which is higher than the "bottom" position when viewed in the heightwise direction of the household dishwasher.

Also within the context of the invention a liquid-conducting washing sub-cycle of a dishwashing program to be performed refers to a washing phase, during which washing liquid is distributed, in particular sprayed, in the treatment chamber by means of the at least one washing apparatus. It has already been described in the introduction how one or more liquid-conducting washing sub-cycles (for example a pre-rinse cycle, cleaning cycle, intermediate rinse cycle and a final rinse cycle performed one after the other) and then a drying cycle to terminate the washing cycle are performed during the course of a dishwashing program to be performed. The essential details there preferably also apply here in the context of the invention. In some instance one or more liquid-conducting washing sub-cycles, for example the intermediate rinse cycle, can be omitted or can be performed a number of times. The washing apparatus can preferably be formed by a spray arm that can be rotated during the respective washing phase with a plurality of spray nozzles, from which washing liquid is sprayed into the treatment chamber. The last liquid-conducting washing sub-cycle, in particular the final rinse cycle, of the washing cycle of the respective dishwashing program is followed by a drying cycle, during which the cleaned items being washed, which have previously been made wet with washing liquid, are dried.

The loading unit to be blown off is preferably an upper rack, which is accommodated in the treatment chamber above a lower rack at a heightwise distance therefrom and can be pulled out of the treatment chamber when the front door of the dishwasher is open. The upper rack preferably has a grid structure of longitudinal and transverse wires. Washing liquid from the spray nozzles of a rotatable spray arm arranged below the upper rack and preferably supported thereon can generally be sprayed from below through the open regions of said grid structure of the upper rack. The items to be washed are generally positioned upside down, in other words on their heads, in the upper rack to allow their hollow spaces, which are soiled with food and/or beverages to be sprayed with washing liquid. They often have a flat depression, for example a hollow, well, groove or other cavity, at the top. Such items to be washed are for example cups, the bottoms of which (when viewed in their use position) curve inward and/or are enclosed by an edge that projects downward. Bowls, basins, drinking glasses and/or other dishes and/or cooking utensils, such as cooking spoons, jars, egg cups, etc. can also have a depression on their base or standing surface, which is then at the top, when they have been positioned upside down in the loading unit, with washing liquid collecting and remaining there after the performance of the respective liquid-bearing washing sub-cycle. This is also true of items being washed, which are placed in the upper rack in their normal use position, for example salad servers, spoons, small bowls, espresso cups, etc. or the like, and have at least one uppermost depression, in which washing liquid can remain after the respective liquid-conducting washing sub-cycle.

To summarize, it is therefore expedient for the one or more fan wheels to be provided in particular above an upper rack, which is preferably accommodated above a lower rack in the treatment chamber. Items to be washed, for example cups, drinking glasses, food/soup bowls, plates, dessert bowls, cereal bowls, breakfast mugs, salad bowls, egg cups, and other small items, which often have a circumferential edge around their base or some other flat depression, are generally placed in the upper rack. If such a container is placed with its base facing upward, in other words upside down, in the upper rack, liquid collects on the top of the respective container, bounded by its upward projecting bottom edge or depression edge, during the respective liquid-conducting washing sub-cycle of a dishwashing program to be performed. This collected liquid is now pressed or pushed sideways out of the depression in the container during the rotation operation of the fan wheel by the air flow generated downward by said fan wheel. If such a blow-off operating phase is performed in particular after the end of the liquid distribution operation of the last liquid-conducting washing sub-cycle, in particular the final rinse cycle, of the washing cycle of the respective dishwashing program, preferably during an end segment of said liquid-conducting washing sub-cycle and/or during a start segment of the drying cycle terminating its washing cycle, or such a blow-off phase is inserted between the end of the liquid distribution operation of the last liquid-conducting washing sub-cycle, in particular final rinse cycle, and the start of the drying cycle terminating the washing cycle, said depression points or wells in the tops of the items being washed can also be dried perfectly or without residue during the remaining period of the drying cycle. No problematic tide marks or deposits advantageously remain.

If the respective fan wheel is driven in a rotating manner in the treatment chamber of the dishwasher cavity (to which washing liquid is applied, thereby wetting it, during the washing operation), an air flow or wind can be generated by it from the air present in the treatment chamber, which preferably strikes a much larger surface from the air outlet region of the fan wheel to the strike point in and/or on the loading unit, in particular at the strike point in and/or on the loading unit, in cross section, in other words in a sectional plane perpendicular to its advance direction or movement direction, than a jet of air in U.S. Pat. No. 6,053,185 or DE 10 2015 013 364 A1, which is expelled from a compressed air nozzle in a focused, in other words spatially very delimited, manner and therefore only strikes a point at a specified location in the upper rack. The air flow generated by the respective fan wheel is in particular less guided, in other words freer, and much more extended or larger in cross section (in a sectional plane perpendicular to its flow direction) from the air outlet region of the fan wheel to the strike point in and/or on the loading unit than the focused jet of air in U.S. Pat. No. 6,053,185 or DE 10 2015 013 364 A1. It is configured in particular in the form of a rotating air flow eddy, which covers a much larger strike surface in and/or on the loading unit than the narrowly focused jet of air in U.S. Pat. No. 6,053,185 or DE 10 2015 013 364 A1, which is directed precisely onto a single point in the upper rack. The inventively generated air flow therefore does not have to be directed precisely onto the items being washed in and/or on the loading unit. It can cover a plurality of items being washed there at the same time.

It is also advantageously possible to change the height position of the loading unit and therefore its heightwise distance from the respective fan wheel arranged above it in the adjustment regions generally provided for it largely without influencing the blow-off effect of the air flow. Successfully performed tests have shown that it is expedient for the respective fan wheel to be expediently provided at a heightwise distance of between 2 cm and 50 cm above the extended or large blow-off region of the surface of the loading unit holding the items to be washed, to which the flow has to be applied, in particular the upper rack. In order to be able to strike as many points as possible in the holding plane of the upper rack with a focused jet of air, with the dishwasher in U.S. Pat. No. 6,053,185 in contrast a plurality of compressed air lines with a very large number of nozzle openings distributed evenly over the top plane of the dishwasher cavity are required. This can be too elaborate in many instances. There are also still gaps between the focused jets from the air nozzles due to the spatial distances or spaces between the fixed, stationary air nozzles, so that in some instances there is not a sufficiently powerful jet of air to push a remaining quantity of liquid out of an uppermost depression point in the respective item being washed that is positioned in the intermediate region between two adjacent air nozzle jets striking at fixed points in the upper rack. The smaller the number of nozzles, the larger the gaps in the upper rack, which are not struck by a jet of air. In U.S. Pat. No. 6,053,185 whether or not liquid remaining in an uppermost depression point in the respective item being washed can be pushed out by a focused jet of compressed air depends on the respective location or position of the item being washed in the upper rack. The efficiency of this stationary nozzle field, which operates with individual singular jets of compressed air that are at a distance from one another and directed and focused in a fixed manner, therefore depends on whether or not the respective item being washed, which has been placed in the upper rack, is precisely in the compressed air jet path of a compressed air nozzle.

The situation is quite different with an air flow generated by a fan wheel according to the invention:

In contrast to an air nozzle, during its rotation operation the respective fan wheel in the treatment chamber of the dishwasher cavity does not generate a focused, in other words narrowly guided or limited, largely straight jet of air, which only strikes a point at a predefined location on the surface for items being washed on the loading unit below it, in other words aimed "precisely" at a singular point or locally very narrowly defined zone of the surface for holding items being washed on the loading unit, but rather a freer air flow of wider cross section (when viewed perpendicular to the air flow direction), in particular a rotating air flow eddy, which actively applies a flow of air present in the treatment chamber of the dishwasher cavity over a much larger area, in other words over a more extensive or more extended area (than a focused jet of air) of the surface for holding items being washed on the loading unit. The blow-off region of the loading unit struck or covered by the air flow of the respective fan wheel (during its rotation operation) is therefore more extended or more extensive, in other words larger (than the focused strike zone of a jet of air generated by a compressed air nozzle).

In particular the air flow generated by the respective fan wheel covers a large blow-off region of the loading unit, which corresponds to at least 10%, in particular between 20% and 100%, preferably between 20% and 25%, particularly preferably around 25% of the overall holding surface or surface for holding items being washed on the loading unit. It is therefore advantageously made possible for the same air flow generated by the respective fan wheel during its rotation operation to strike or cover a plurality of items being washed at the same time, said items being positioned on the surface for items being washed on the loading unit and being located in the extended or large blow-off region. The blowing off of any liquid present on the respective items being washed, in particular a quantity of liquid remaining on their tops, is independent of the respective location of the items being washed in the loading unit here. Precise direction of the air flow onto the individual locations of the items being washed in the loading unit, which is below the one or more fan wheels in the treatment chamber, is not necessary, in particular as long as a preferred direction of the air flow from top to bottom is present. The free air flow generated by a rotating fan wheel and configured in particular as an air flow eddy strikes a much larger strike surface on the top holding or standing surface of the loading unit with air than the focused jet of air from an individual compressed air nozzle. It also preferably has approximately the same flow impetus over its cross sectional area and in particular at any strike point on the strike surface it covers or meets on the loading unit. The air flow inventively generated by means of a rotating fan wheel therefore supplies the surface it strikes in and/or on the loading unit and therefore any items being washed supported thereon more homogeneously or evenly than is possible with the individual air nozzle jets of the nozzle field in U.S. Pat. No. 6,053,185 or DE 10 2015 013364 A1.

Because during the respective blow-off phase or other fan operating phase the air flow generated by the respective fan wheel during its rotation operation, in particular the air eddy generated by the respective fan wheel, strikes a large blow-off region of the loading unit arranged below the fan wheel with approximately the same flow impetus, in other words evenly, over its cross sectional area, the items being washed positioned there are pushed or pressed largely evenly downward against the standing plane of the loading unit and therefore remain largely stable in respect of position. The respective item being washed is struck by approximately the same downward, in particular vertically downward, force component of the downward, in particular vertically downward, air flow generated by the respective fan wheel during its rotation operation, at every point on its top face. This largely prevents an item being washed being struck on one side by a force component in an unwanted manner, as can happen with a singular nozzle air jet in U.S. Pat. No. 6,053,185 or DE 10 2015 013364 A1, changing its position or even tipping it over. It makes damage or other detriment to the items being washed in the large blow-off region of the loading unit struck by the air flow of the respective fan wheel unlikely.

The inventive fan wheel is expediently configured in such a manner that it generates an extensive air flow when viewed in a sectional plane perpendicular to the air flow direction, in particular a rotating air flow eddy, in one or more blow-off operating phases during its rotation operation, said air flow having a cross-sectional area preferably between 450 $cm^2$ and 2000 $cm^2$ for a household dishwasher of 45 cm standard width and 60 cm standard depth and preferably between 500 $cm^2$ and 2500 $cm^2$ for a household dishwasher of 60 cm standard width and 60 cm standard depth when viewed perpendicular to its main flow direction.

According to one advantageous development of the invention the respective fan wheel is configured as an axial fan, in particular as a propeller or impeller. The rotation axis of an axial fan runs approximately parallel or axial to the air flow. Its simple structure is one advantage. A further advantage is its small dimension when viewed in the axial direction or axial throughflow direction, relative to the high conveyed air throughput; in other words it has the structure of a flat unit when viewed in the axial throughflow direction, in other words perpendicular to its rotation circle covered by its one or more blades or vanes. Its height is preferably between 4 and 6.5 times smaller than the diameter of its rotation circle.

If the respective axial fan is accommodated in the treatment chamber of the dishwasher cavity in particular in such a manner that its rotation circle described by its blades or vanes during ventilation or fan operation is largely horizontal, in other words its rotation axis extends essentially vertically, it can be accommodated particularly favorably in the treatment chamber without taking up much height, in particular requiring a height between 1 cm and 4 cm (calculated without associated drive, in particular without associated electric drive motor). The respective axial fan is advantageously arranged above a large or extended blow-off region, which is desirable in the surface for holding items being washed on the loading unit, in particular an upper rack. Its flat structure means that it can be positioned in particular in and/or on a framework, for example also on a cutlery drawer, which is arranged immediately above the loading unit, in particular an upper rack, to which the flow is to be applied, at a different height in the treatment chamber without taking up too much space. During a blow-off operating phase the respective axial fan thus mounted therefore generates an air flow with an extended cross section (when viewed perpendicular to the flow direction) with a forward impetus from top to bottom, preferably in a vertical direction. It preferably strikes a large partial area or even the whole area of the top surface for holding items being washed on the loading unit on a direct path, in other words largely unimpeded. This air flow can therefore blow the tops of all the items being washed, which are standing on the loading unit in said extended or large strike region of the air flow, at the same time. The tops of the items being washed are therefore struck directly by an unguided free flow of large area in cross section, with the flow impetus originally imparted to it by the axial fan largely unattenuated, in other words largely without flow impetus losses due to diversions or deflections. A quantity of liquid present on the top of the respective item being washed can be blown off optimally by this air flow, which is directed from top to bottom and is in particular vertical. In particular said air flow can push a quantity of liquid that has collected in an uppermost depression, e.g. well, hollow or other cavity, in the respective item being washed out of said depression, so the liquid runs out of the depression and flows down to the bottom of the dishwasher cavity of the household dishwasher. It also largely ensures that the items being washed struck by the air flow, which are arranged in the large blow-off region of the loading unit assigned to said air flow, remain standing in a stable manner.

The respective axial fan allows air to be drawn from the treatment chamber in a simple manner for a blow-off operating phase and to be accelerated in such a manner that an air flow, in particular an air flow eddy, is generated with a fast advance speed, which is sufficient largely to blow off or blow down a quantity of liquid present on the top of the respective item being washed, in particular liquid that has collected in an uppermost depression in the respective item being washed.

Preferably the one or more blades or vanes of the axial fan wheel each have a radial length (measured from the center or rotation axis of the axial fan wheel radially outward), which is approximately half the diameter of the circular surface, which is desired, in other words required, as the respective blow-off zone or blow-off region within the surface for holding items being washed on the loading unit.

The air flow generated by a fan wheel, in particular an axial fan wheel, allows a flow to be applied to a large region in the loading unit arranged below it, preferably in a largely even manner, blowing the tops of items being washed that are supported there. Few fan wheels, in particular fewer than 6 fan wheels, preferably between two and four fan wheels, are therefore sufficient to apply a flow to the entire occupied surface or loading surface of the loading unit.

It may be favorable in particular for a fan wheel, in particular an axial fan wheel, to be arranged above each of the four quadrants of the approximately rectangular layout of the surface for items being washed or holding surface of the loading unit to be supplied with a flow of air in each instance, in particular the upper rack. The four fan wheels can then generate four air flows. One quadrant of the surface for items being washed on the loading unit can be supplied with a large air flow when viewed in cross section, in particular with a rotating air flow eddy. Such an air flow eddy can be applied in particular by the rotational operation of an axial fan wheel, the one or more blades of which each have a radial length, which is preferably approximately half the length of the widthwise and/or depthwise extension of the respective quadrant. This specific assignment of four fan wheels to the four quadrants of the loading unit essentially allows the entire surface for items being washed on the loading unit, in particular the upper rack, to be blown with air.

With a household dishwasher with external dimensions of 60 cm width and 60 cm depth for example a loading unit accommodated in its dishwasher cavity and able to be pulled out therefrom, for example an upper rack, has dimensions of around 48 cm width and around 50 cm depth, therefore a holding surface between 2000 $cm^2$ and 2500 $cm^2$. If the approximately rectangular layout of the basic holding surface of the loading unit is advantageously divided into four quadrants of approximately equal size, and an axial fan wheel above is specifically assigned to all four quadrants respectively, the respective axial fan wheel is expediently dimensioned in such a manner that its respective blade has a radial extension (measured from the rotation axis of the axial fan wheel radially outward) in particular between 8 cm and 12 cm.

In some instances a different assignment of one or more fan wheels to one or more quadrants or zones of the treatment chamber and/or the loading unit to be blown off may be expedient. For example fewer than four quadrants, in particular only between one and three quadrants, preferably only two quadrants can be supplied with the flow of air from a fan wheel positioned above the respective quadrant. If for example when looking from the front into the treatment chamber of the household dishwasher, only the two left quadrants of the loading unit, positioned one behind the other, are to be available as zones for holding items being washed, it is sufficient for a fan wheel only to be accommodated above each of these quadrants respectively in the treatment chamber. The remaining space above the two right quadrants is then free of fan wheels.

Alternatively, in the opposite of this arrangement, the two fan wheels can be arranged above the two right quadrants, with no fan wheels assigned to the two left quadrants.

Generally therefore it may be expedient for one or more fan wheels to be assigned to above a first region of the holding surface of the loading unit, while no fan wheels are assigned to above a second region of the holding surface of the loading unit. If a shared framework for the one or more fan wheels is provided above the loading unit to the blown off, a first region of the framework is therefore fitted with one or more fan wheels, while a second region remains free of fan wheels. This is then available for other use. It can be configured in particular as a cutlery holder and/or a support zone for items to be washed, in particular small items.

In a further advantageous variant a single fan wheel, in particular an axial fan wheel, may be sufficient to blow their air flow it generates onto the entire surface for holding items being washed on the loading unit. To this end it may be expedient for said single fan wheel preferably to be positioned above the loading unit to be blown off in the center of its rectangular layout. With a household dishwasher with expedient external dimensions of 60 cm width and 60 cm depth for example, in which a loading unit, which is accommodated in the dishwasher cavity and can be pulled out therefrom—for example an upper rack—preferably has dimensions of approximately 48 cm width and 50 cm depth, a single fan wheel, in particular axial fan wheel, which can be driven in a rotating manner and is arranged centrally above said holding surface, may be sufficient to blow air onto the entire holding surface of said loading unit, the radial extension (measured from the rotation axis of the axial fan wheel radially outward) of the respective blade of said centrally arranged axial fan wheel expediently being between 20 cm and 24 cm.

Extensive tests have shown that it is favorable in practice for blowing off normal quantities of liquid that can remain in particular in depressions on standard items being washed in the respective household completely after the respective liquid-conducting washing sub-cycle of the washing cycle of a dishwashing program to be performed, if the respective fan wheel is driven in a rotating manner by a drive assigned to it such that the air flow it generates strikes the large blow-off region assigned to the fan wheel on the top of the loading unit arranged below the fan wheel with an advance speed of at least 5 m/sec, in particular between 8 m/sec and 20 m/sec, preferably between 9 m/sec and 15 m/sec, particularly preferably around 15 m/sec.

In order to achieve such a high flow speed for the air flow, according to one advantageous development of the invention a drive is expediently assigned to the respective fan wheel, in particular the respective axial fan wheel, driving it in a rotating manner in the respective blow-off operating phase with a target speed preferably of at least 5000 revolutions/minute, in particular with target speeds between 5000 revolutions/minute and 10000 revolutions/minute, preferably between 6000 revolutions/minute and 8000 revolutions/minute. Successful tests with such revolution figures for axial fan wheels have shown that the flow impetus imparted to the generated air flow is then sufficient to blow away the quantity of liquid generally remaining on the top of the respective item being washed.

This ensures that during the blow-off operating phase the air in the treatment chamber is moved or accelerated by the respective fan wheel, which is rotating in this rapid manner, to such a degree that it outputs an air flow with a flow impetus into the treatment chamber onto the items being washed in the loading unit, said flow impetus being sufficient largely to blow off normal quantities of liquid remaining on the tops of the items being washed. An air flow thus generated can therefore not only blow liquid droplets off the respective item being washed, it can also blow off a larger quantity of liquid than the quantity of liquid in a liquid droplet, in particular a quantity of liquid or collected liquid between 3 ml and 200 ml from the respective item being washed.

The one or more fan wheels can favorably be supported or positioned on a shared framework, for example a cutlery drawer. This framework is preferably accommodated above the loading unit to be subjected to the flow, in particular above an upper rack, in the dishwasher cavity. Said framework is preferably configured so that it can be removed, in particular pulled out, so that the one or more fan wheels positioned thereon are easily accessible if required, for example for repair or cleaning. Said framework can in particular be provided at the point in the treatment chamber of the dishwasher cavity, where a pull-out cutlery drawer is otherwise provided. Alternatively it can be particularly favorable for the one or more fan wheels to be supported on a cutlery drawer itself, which is arranged in the treatment chamber of the dishwasher cavity above the upper rack with a heightwise distance or free height between them. In particular it is advantageous for the one or more fan wheels to be incorporated in the framework or supported thereon, in particular in or on the cutlery drawer, in the flattest manner possible, so that they are largely flush with or only project slightly beyond the latter's predefined, in particular upper and/or lower, outer boundary line. The one or more fan wheels are preferably supported on the framework, in particular the cutlery drawer, in such a manner that their one or more blades or propellers only project downward a little, in particular by maximum 3 cm, or not at all beyond the lower edge or lower face of the framework. This means that the spatial conditions in the treatment chamber of the dishwasher cavity are essentially maintained, compared with those in a conventional dishwasher (without fan wheel(s)). This largely protects the one or more blades or propellers of the respective fan wheel against blocking and/or damage due to mechanical intervention in their rotation path, for example by the hand of a user when inserting or removing items to be washed in or from the upper rack, which is arranged below the framework at a free distance therefrom, or during ongoing operation of the dishwasher due to an item being washed that projects upward into the upper rack arranged below the framework at a free distance therefrom.

In addition to or independently thereof the respective fan wheel can also be positioned on the lower face of the top wall of the dishwasher cavity in the treatment chamber, in particular hanging down, in order to blow a cutlery drawer arranged below it and/or an upper rack arranged below it in particular with air if required during at least one blow-off operating phase. According to this alternative the loading unit to be blown off can therefore if required also be a cutlery drawer, which is preferably arranged above the upper rack and serves to hold cutlery items and/or small tableware items, such as espresso cups.

If in addition to or independently thereof liquid is to be blown off the tops of items being washed that are supported in the lower rack, it can be expedient in some instances, in addition to or independently of the above arrangements of the one or more fan wheels, to position the respective fan wheel on the upper rack and allow it to generate an air flow from top to bottom onto the lower rack if required during a blow-off operating phase. In this advantageous variant the loading unit to be blown off can therefore be a lower rack. The one or more fan wheels can then expediently be positioned on the upper rack arranged above the lower rack at a heightwise distance therefrom.

It is also possible in some instances for one or more fan wheels to be positioned in an upper region of a side wall and/or the rear wall of the dishwasher cavity in the treatment chamber at a sufficient height for an air flow to be output downward onto a loading unit, for example the upper rack, which is lower than the location of the respective fan wheel. For example a fan wheel can be accommodated in each of the two rear upper corners or in particular in each of the four upper corners of the treatment chamber. The respective fan wheel then preferably generates an air flow directed obliquely downward onto the desired blow-off region assigned to it in the plane of the loading unit in which items to be washed are supported during rotation operation.

A controller is expediently provided, which can be used to switch a drive assigned to the respective fan wheel, in particular an electric drive motor, on and then off again for its rotation operation. The controller can comprise a control and/or regulation unit, which can be used to set the speed of the drive, in particular the electric drive motor, during its switch-on operating phase. According to one advantageous development of the invention this controller ensures that the drive assigned to the respective fan wheel is operated in the switched on state only for a predefined runtime sub-segment of the overall runtime duration of the blow-off operating phase or during the overall runtime duration of the blow-off operating phase after the end of the liquid distribution operation of a liquid-conducting washing sub-cycle, in particular a final rinse cycle, of a dishwashing program to be performed, in particular during an end segment of said liquid-conducting washing sub-cycle and/or during a start segment of the drying cycle terminating its washing cycle. The controller for the one or more drives can be components of a different controller of the household dishwasher, for example a high-order main controller, which is responsible for the washing program sequence of the respectively selected dishwashing program. Alternatively the controller can be assigned to the drive of the respective fan wheel in particular as a separate unit. It can preferably be accommodated in the treatment chamber and be configured to prevent washing water ingress. The framework described above, the one or more fan wheels and said controller can advantageously be combined in a common assembly unit. It can in some instances also include the drive(s) for the one or more fan wheels.

A blow-off operating phase can preferably be performed during an end segment of a liquid-conducting washing sub-cycle, for example the cleaning cycle or final rinse cycle of a dishwashing program, if the liquid application operation or liquid distribution operation by means of the at least one washing apparatus has been stopped in the treatment chamber. Where the washing apparatuses comprise one or more rotatable spray arms, this is particularly so if the circulating pump, which supplies the one or more spray arms with liquid by way of one or more supply lines, stops its circulating operation, in other words has been switched off. Blowing off can then cause residual water to be made to flow to the bottom of the dishwasher cavity more efficiently from the loading unit and/or items being washed that are supported there. It preferably collects there in the sump and can optionally be pumped out of the dishwasher cavity partially or completely in particular by means of a drain pump.

If a blow-off operating phase is performed in particular between two successive liquid-conducting washing sub-cycles, for example between the cleaning cycle and the following intermediate rinse cycle, and/or between the intermediate rinse cycle and the following final rinse cycle, this can be favorable, as it more reliably prevents the transfer of dirty residual water, which can contain cleaning agents, rinse aid and/or additional substances, from a preceding liquid-conducting washing sub-cycle to a following washing sub-cycle. It may be of particular interest that residual water containing cleaning agent from the cleaning cycle cannot get into the final rinse cycle, as transferred cleaning agent can impair the action of the rinse aid. The most efficient elimination possible of residual quantities of liquid from the items being washed is also advantageous, as it prevents there being an undefined washing liquid level in the dishwasher cavity, in particular for the following liquid-conducting washing sub-cycle. The elimination of such residual quantities of water from the tops of the items being washed by blowing off means that said residual quantities of water do not also have to be heated during a subsequent liquid-conducting washing sub-cycle, which is based on a defined quantity of washing liquid to be heated in the dishwasher cavity, thereby saving heat energy.

If the respective fan wheel is operated switched on for a predefined runtime sub-segment of the overall runtime duration of the blow-off operating phase or during the overall runtime duration of the blow-off operating phase after the end of the liquid distribution operation of the last liquid-conducting washing sub-cycle, in particular the final rinse cycle, of a dishwashing program to be performed, in particular during an end segment of said liquid-conducting washing sub-cycle and/or during a start segment of the drying cycle terminating the washing cycle of said dishwashing program, liquid that has collected in depressions, for example hollows or wells, in the items being washed, can largely be blown out of these, so that said quantities of liquid drop to the bottom and collect at the bottom of the dishwasher cavity, in particular in its sump. Puddles of liquid remaining in uppermost depressions in the items being washed are therefore removed beforehand, in other words before and/or during a start segment of the drying cycle by being blown off by moving air from the treatment chamber. The drying cycle itself can be performed by means of a specifically provided drying system, for example a residual heat drying system, convection drying system, condensation drying system, heat exchanger drying system, sorption drying system, door opening drying system, etc. or combinations thereof. Combining a preceding or initial blow-off operating phase with one of these drying methods, in which the moisture content of the air in the wash chamber is reduced successively within a predefined drying time for the drying cycle, in other words the air in the wash chamber is dried specifically within a predefined drying time for the drying cycle, ensures that even the surfaces in uppermost depressions in the items being washed are dried largely completely. Visible tide marks or deposits in the depressions in the items being washed are thus avoided.

Also the blow-off phase inserted between the last liquid-conducting washing sub-cycle, in particular final rinse cycle, and drying cycle of a dishwashing program advantageously allows the temperature, at which the washing liquid is heated by at least one heating facility, to be lowered during the last liquid-conducting washing sub-cycle, in particular final rinse cycle, of the washing cycle of the dishwashing program to be performed in each instance, compared with the temperature of the last liquid-conducting washing sub-cycle, in particular final rinse cycle, of a dishwashing program without blow-off phase (between the final rinse cycle and drying cycle), thereby saving electrical energy, as by blowing the items being washed with air it is possible to cause not only any liquid that has collected in uppermost depressions in the items being washed to run down to the bottom of the dishwasher cavity but generally also to make the liquid droplets adhering to the items being washed drop more readily downward to the bottom of the dishwasher cavity, so that the items being washed are already drier at the start of the drying cycle of the respective dishwashing program and the wash chamber air or process air in the dishwasher cavity is generally less moisture-laden than before (without blow-off phase). This advantageously means that a lower heating temperature is sufficient for the items being washed and the air in the treatment chamber or holding chamber of the dishwasher cavity for complete residual heat drying and/or condensation drying. In particular a smaller temperature difference between the walls of the dishwasher cavity and the items being washed or the wash chamber air or process air is sufficient to be able to condense out moisture still contained in the wash chamber air or process air satisfactorily on the dishwasher cavity walls, which are cooler than the air/steam mixture in the wash chamber. In the case of a sorption drying facility a smaller quantity of sorption material can be sufficient to absorb, in particular adsorb, the liquid in the wash chamber air and/or adhering to the items being washed. The outlay, in particular for electrical energy, can thus be reduced for the liquid-conducting washing sub-cycle, in particular final rinse cycle, preceding the drying cycle and/or for the drying cycle of the washing cycle of the respective dishwashing program.

If multiple fan wheels are arranged in a distributed manner, in particular in a common positional plane, above the loading unit holding the items being washed that is to be blown off, it may be particularly advantageous for the multiple fan wheels to be driven in a rotating manner individually one after the other during runtime sub-segments assigned selectively to them in the respective blow-off operating phase, in other words the rotation operating phases of the fan wheels are performed sequentially or in series. Such selective rotation operating phases of the multiple fan wheels with their temporal offset over the overall duration of the respective blow-off operating phase mean that drive energy is only required during the respective runtime sub-segment for the drive or the drive apparatus of the individual fan wheel to be driven in a rotating manner during said runtime sub-segment and not the accumulated drive energy for the drive apparatus(es) of multiple or all the fan wheels at the same time. This simplifies the provision of electrical power or the supply of electrical energy for the drives of the multiple fan wheels. An individual runtime or selectively assigned runtime sub-segment preferably between 5 sec and 30 sec, in particular between 8 sec and 20 sec, more preferably between 10 sec and 20 sec, particularly preferably around 15 sec is preferably selected for the respective fan wheel during the overall duration of the blow-off operating phase. If for example an individual fan wheel is specifically assigned to each of the four quadrants of the loading unit to which the flow is to be applied and these four fan wheels are operated individually, in other words alone, one after the other according to the above individual runtimes, an overall runtime duration preferably between 20 sec and 120 sec, in particular between 32 sec and 80 sec, more preferably between 40 sec and 80 sec, particularly preferably around 60 sec (seconds) results for the respective blow-off operating phase. In some instances the overall runtime duration of the blow-off operating phase can preferably be 10% to 20% longer than this due to pauses or dead time between the individual runtimes of the fan wheels. This advantageously allows the respective blow-off operating phase to be integrated in the normal sequence of a dishwashing program almost without significant delay.

The temporally separated, successive rotation operating phases or intervals of the multiple fan wheels over the overall duration of the respective blow-off operating phase mean that disruptive air turbulence is largely avoided in the air flows generated by them, in particular air flow obliteration or air flow short circuits, preferably in the intermediate region between adjacent fan wheels. As only a single fan wheel is ever driven actively by the drive assigned to it or runs in the respective interval of the blow-off operating phase, while the drives assigned to the other fan wheels are switched off and stand still, only the, in particular electrical, power for this one active drive has to be provided per interval. Associated with the sequential sequence of individual operating phases of the fan wheels, the amount of noise generated is also limited to the noise generated by the single, actively driven fan wheel and/or by its assigned drive per interval or rotation operating phase. If the drive for the respective fan wheel is expediently an electric motor, in particular a brushless, washing water-resistant wet rotor motor, as used in a standard discharge pump or drain pump of a conventionally configured household dishwasher for example, an electrical power input (rated power) preferably between 40 W and 80 W is advantageously sufficient for the respective fan wheel to generate an air flow with an advance speed of preferably around 9 m/sec-15 m/sec for in particular 10 sec to 15 sec. If there are four electric motors for four fan wheels, which are assigned to the four quadrants of the overall holding surface of the loading unit, an overall electrical power input of between 160 W and 320 W preferably results relative to the overall duration of the respective blow-off operating phase. This corresponds to a total energy consumption of preferably only between 1600 Wsec and 4800 Wsec for an assumed individual fan runtime in particular of around 10 sec (seconds) to 15 sec during the respective blow-off operating phase. The temporally selective, in other words individual, rotation operating phases of the multiple fan wheels, spread over a number of intervals of the respective blow-off operating phase corresponding to their number mean that it is sufficient to provide a power module that is only designed for the electrical energy supply to the individually active electric drive motor in each instance. In the case of an electric drive motor with a predefined, for example around 80 W, rated power, this means that the electrical power module also only needs to be designed to output this rated power to said electric drive motor and not to output the sum of the electrical rated powers of all the drive motors. The sequential sequence of the rotation operating phases of the multiple fan wheels means that the transfer of electrical power to the electric drive motor of each fan wheel, in particular by way of an electrical power module of the household dishwasher, which can preferably be provided within the wash chamber, optionally also outside the treatment chamber, is limited to the rated power of the individual electric drive motor active in each instance, which is lower than the accumulated overall rated power of the electric drive motors of all the fan wheels and can therefore be achieved more easily than if the electric drive motors of all the fan wheels were to run at the same time during the blow-off operating phase.

According to one further expedient development of the invention a touch guard, for example a cage or protective grille, can be provided for the respective fan wheel, in particular on its air inlet opening and/or air outlet opening. This largely prevents mechanical damage to and/or blocking of the respective fan wheel.

According to one advantageous development of the invention a controller, in particular a control and/or regulation unit, of the inventive household dishwasher can switch the drive of the respective fan wheel on to move air in at least one further process phase of the washing cycle and/or for at least one process step outside the washing cycle and operate it for a predefined time period in addition to the respective blow-off operating phase of the washing cycle of a dishwashing program to be performed. It controls at least one parameter of the drive, in particular electric drive motor, of the respective fan wheel in such a manner that it rotates with a desired set point speed or according to a desired speed profile.

After performing the blow-off operating phase of the washing cycle, which is performed after the end of the liquid application operation of the last liquid-conducting washing sub-cycle, in particular the final rinse cycle, the washing cycle and/or during a start segment of the following drying cycle of the washing cycle, performed by means of the at least one washing apparatus, the controller can thus for example operate the drive for the respective fan wheel in such a manner that during at least one convection operating phase in the drying cycle the respective fan wheel rotates at a speed which is lower than the speed of the respective fan wheel in the preceding blow-off operating phase. Such forced circulation of moist air and/or water vapor in the treatment chamber can in particular favor the condensing of moisture from the moist hot air on a cold wall surface, for example on a side wall of the dishwasher cavity. If drying is assisted by opening the door slightly, the moist hot air and/or water vapor can be blown out of the treatment chamber by the respective fan wheel driven in a rotating manner through a gap between the door and the dishwasher cavity. In some instances the fan wheel can also be made to rotate when it is desirable to exchange air for ambient air, for example by way of a door gap or specifically provided air duct, to eliminate unpleasant odors in the wash chamber. This may be the case for example during a phase when the dishwasher is not used and no dishwashing program runs. In such instances, in which forced convection is used, a speed of preferably less than 4500 revolutions/minute is sufficient for the rotation operation of the respective fan wheel.

The invention also relates to a method for operating a household dishwasher, which has a dishwasher cavity, in the treatment chamber of which at least one loading unit for holding items to be washed is accommodated, and at least one washing apparatus for applying washing liquid to the treatment chamber, which is characterized in that one or more fan wheels provided above the loading unit in the treatment chamber of the dishwasher cavity are driven in a rotating manner in at least one blow-off operating phase such that air from the treatment chamber is drawn in, accelerated and moved forward and downward from said fan wheel as an air flow in the treatment chamber, said air flow striking a large blow-off region at the top of the loading unit arranged below the fan wheel and largely blowing off quantities of washing liquid present on the tops of items being washed that are supported there.

It can be expedient in particular, if there are multiple fan wheels provided in the treatment chamber, in particular four fan wheels assigned to the quadrants of the upper rack, for these multiple fan wheels to be driven in a rotating manner individually one after the other, in other words sequentially or gradually, during the respective blow-off operating phase. The temporally separated rotation operation of the multiple fan wheels means that disruptive air turbulence, in particular air flow obliteration or air flow short circuits, is largely avoided preferably in the intermediate region between adjacent fan wheels. In other words the air flows generated at different times by the multiple fan wheels remain largely unaffected by one another.

If an, in particular electric, drive motor is assigned specifically to each fan wheel, such temporal splitting of the individual fan runtimes of the fan wheels over the overall duration of the respective blow-off operating phase advantageously requires a smaller electrical power than when the electric drive motors of all the fan wheels are operated at the same time over the overall duration of the blow-off operating phase. The temporally separated individual operation of each of the fan wheels means that the transfer of electrical power to the electric drive motor of each fan wheel, in particular by way of an electrical energy provision module or a power module of the household dishwasher, which can preferably be provided within the wash chamber, in some instances however also outside the treatment chamber, is simplified. In the case of a cable feed a smaller power cross section suffices for the electrical feed supply line to the power module and the respective distributor line from the latter to the respective electric drive motor. The temporally separated individual operation of each fan wheel during the respective blow-off operating phase is in particular also advantageous if the electric drive of the respective fan wheel obtains its electrical energy supply from a rechargeable electrical energy store, as an electrical energy store with a relatively small energy storage capacity, in particular maximum 5000 Wsec then suffices for an exemplarily assumed individual fan runtime of around 10 sec (seconds) to 15 sec, with the result that it takes up little space. Such an electrical energy store can also be positioned in particular on the framework on which the fan wheels are supported in the treatment chamber. In the case of a contactless energy transfer, for example inductively, between an energy provision module or power module of the household dishwasher provided outside the treatment chamber and a rechargeable energy store in the treatment chamber, a smaller primary and secondary coil are already sufficient.

It can be advantageous in some instances if the speed of the respective fan wheel provided in the treatment chamber is varied during its respective rotation operation, in particular during its selectively assigned runtime sub-segment in the blow-off operating phase or over the overall runtime duration of the blow-off operating phase. This allows the flow speed of the air flow generated by the respective fan wheel during its rotation operation to be changed over the runtime of the respective fan wheel. It can be expedient in particular for the respective fan wheel to be driven in a rotating manner by means of a drive assigned to it such that its speed alternates between an upper and lower target speed value. This pulsing speed change brings about pulsing of the flow impetus of the generated air flow. This dynamic variation of the flow impetus of the air flow allows the liquid remaining in an upper most depression in an item being washed to be pushed out and made to flow away more efficiently, as the residual liquid, which could not be pushed over the edge of the depression in the item being washed, the top of which is to be blown off, but instead remained "suspended" there, can run back from the outer edge of the depression to the bottom and collect there during the period between two maxima of the flow impetus, for this collected residual liquid then to be conveyed over the edge of the depression when the flow impetus increases to the next maximum. This improves the efficiency with which the quantity of liquid remaining in the depression in the respective item being washed can be removed therefrom.

It can be expedient in some instances for the respective fan wheel to be driven in a rotating manner in particular during the runtime sub-segment assigned to it in the respective blow-off operating phase such that its speed is increased to a target speed based on a rising speed profile. In particular it follows a speed profile from zero revolutions/minute to a maximum speed, maintains this for a predefined time period and then returns to zero revolutions/minute. This speed increase allows the liquid remaining in the uppermost depression in an item being washed to be conveyed over the edge of the depression with momentum.

It can be advantageous in some instances, if there are multiple, in particular four, fan wheels provided in the treatment chamber, for these multiple fan wheels to be drive in a rotating manner at different speeds from one another during their runtimes. This allows different flow speeds to be imparted to the air flows generated by the fan wheels as further degrees of freedom. It is thus possible to adjust the speeds of the air flows based on different loading situations in different loading zones of the loading unit in a flexible manner. Thus the speed of the fan wheel assigned to a loading zone of the loading unit provided for items to be washed, e.g. espresso cups, with smaller depressions in their bases, can be lower than the speed of the fan wheel assigned to a loading zone of the loading unit provided for items to be washed, e.g. cereal bowls, with larger depressions in their bases.

The changes to the speed of the respective fan wheel are expediently made by a controller, in particular a control and/or regulation unit, which changes at least one parameter of the drive assigned to the respective fan wheel. If the drive is an electric drive motor, the controller can in particular vary its electric feed current and/or feed voltage.

A specific, individual drive is preferably assigned to each fan wheel. If there are a number of fan wheels present, these are therefore coupled individually to a number of drives that is the same as their number.

Alternatively the number of drives can be smaller than the number of fan wheels. Then a number of fan wheels can be driven in a rotating manner at least by one of the drives. In particular only one drive can even be provided, which is then coupled to all the fan wheels at the same time, in other words in a shared manner.

An electric drive motor is preferably provided as the drive which can be used to cause the respective fan wheel to rotate. It can be an electric motor coupled specifically to the drive shaft of the respective fan wheel. Alternatively it can also be possible to connect an electric motor already present in the household dishwasher, for example the electric motor of the circulating pump or the electric motor of the drain pump, to the drive shaft of the one fan wheel for its rotation or the drive shafts of the multiple fan wheels for their rotation by way of at least one coupling apparatus. Optionally, instead of an electric drive motor, a fluidically controlled drive apparatus, for example a hydraulic drive apparatus or pneumatic drive apparatus, a magnetic drive apparatus or some other drive apparatus such as a water turbine for example, can be provided for the fan wheel to be driven in a rotating manner in each instance. For example the circulating pump could also drive a water turbine as it circulates liquid, thereby generating electrical energy, which is stored in an electrical energy store. This stored electrical energy is then available to drive the electric drive motor assigned to the respective fan wheel in the desired blow-off operating phase and/or other air movement phase.

The invention also relates to an apparatus with one or more fan wheels to be incorporated in the treatment chamber of a household dishwasher, the one or more fan wheels being configured according to at least one of the preceding embodiments and/or according to at least one of the claims. This apparatus can preferably have a framework or support structure, on which the one or more fan wheels is/are supported or positioned. Also according to one advantageous development one or more, in particular electric, drive motors of the one or more fan wheels, one or more energy supply lines leading to the electric motor(s) of the one or more fan wheels and/or a controller for operating the one or more drives can be provided on the framework. This framework is preferably configured to be accommodated above the loading unit to which the flow is to be applied, in particular above an upper rack, in the dishwasher cavity.

The advantageous configurations and developments of the invention described above and/or set out in the subclaims can be applied individually or in any combination, except for example in instances of unambiguous dependencies or irreconcilable alternatives.

BRIEF DESCRIPTION OF THE DRAWINGS

Other developments of the invention are set out in the subclaims. The invention and its advantageous developments are described in more detail below based on drawings, in which, shown schematically in each case:

DETAILED DESCRIPTION OF EXEMPLARY EMBODIMENTS OF THE PRESENT INVENTION

Figure 1:
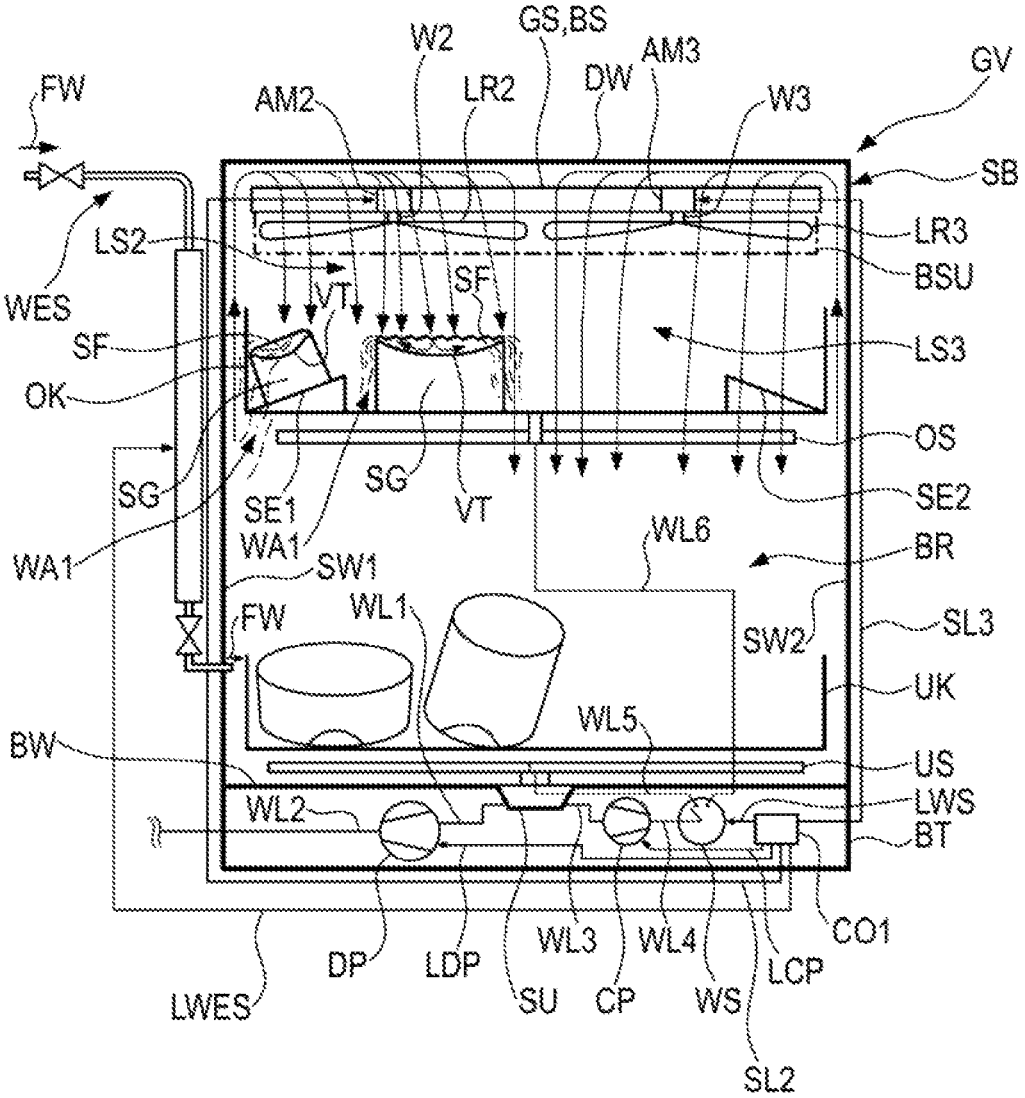
FIG. 1 shows a schematic diagram of a first exemplary embodiment of an inventively structured household dishwasher, in the treatment chamber of which multiple, in particular four, fan wheels, which can be driven in a rotating manner, are provided to perform at least one blow-off operating phase during a dishwashing program to be performed.
Figure 2:
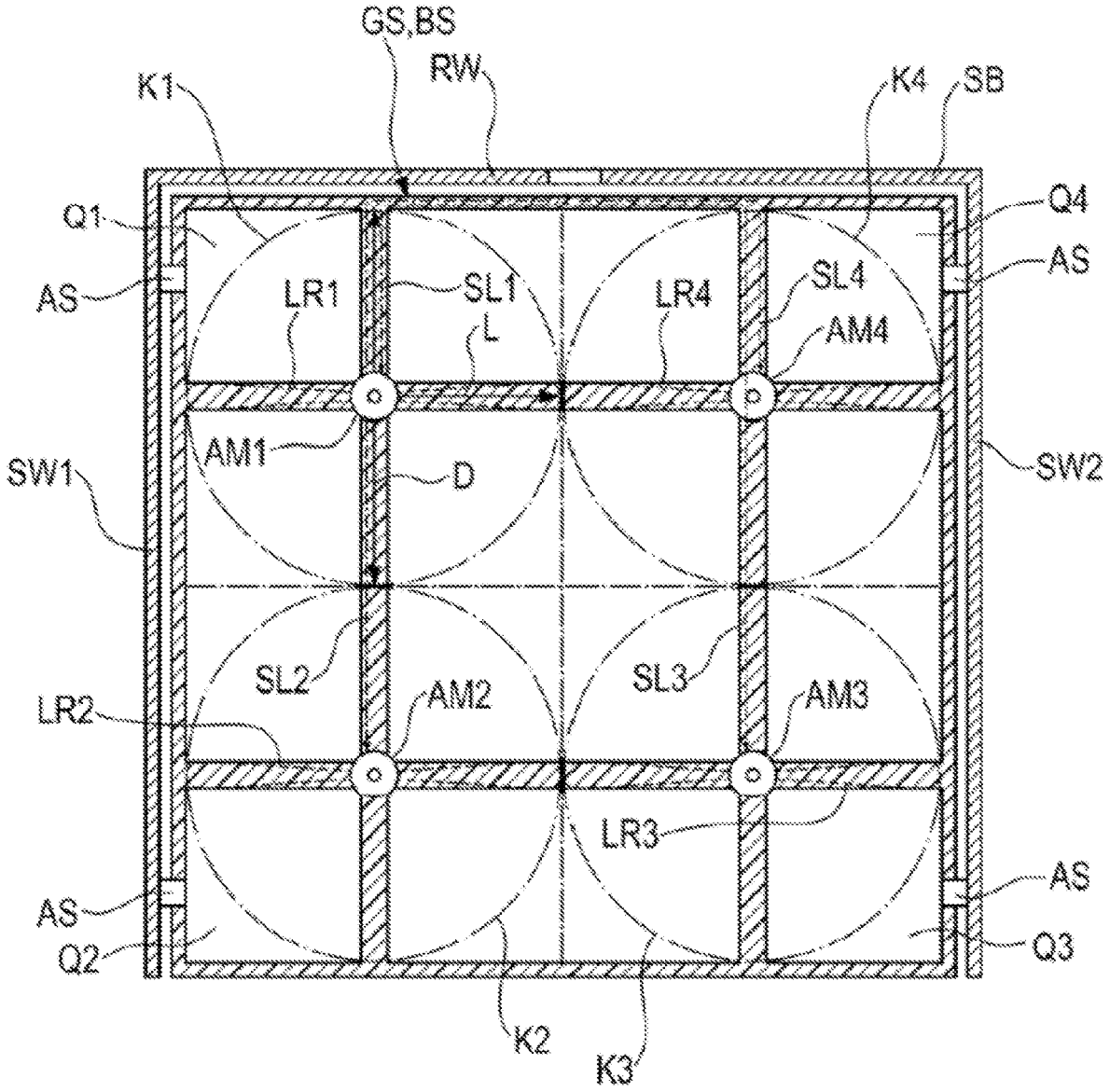
FIG. 2 shows a detail from FIG. 1 showing a schematic top view of a framework, on which the multiple fan wheels are supported in the treatment chamber of the household dishwasher in FIG. 1.
Figure 3:
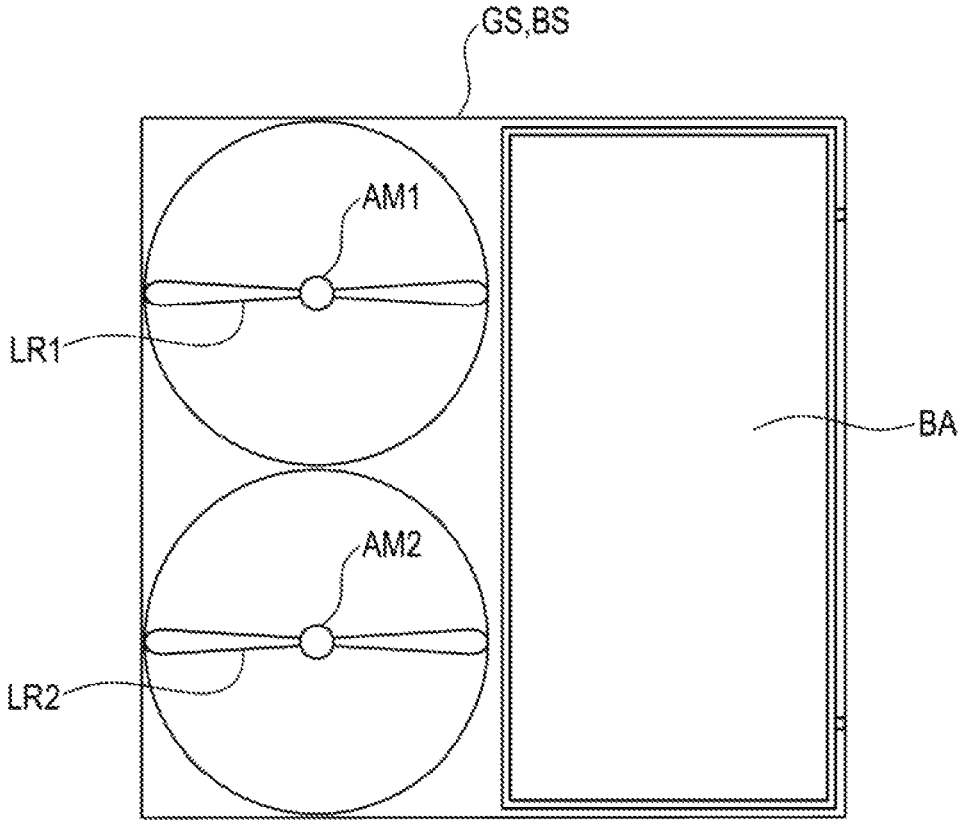
FIG. 3 shows a schematic top view of a cutlery drawer, in which two fan wheels that can be driven in a rotating manner are provided in the left half (viewed from the front) and a holding apparatus for cutlery and/or small tableware items or other household utensils, such as for example espresso cups, salad servers, egg cups, etc., is provided in the right half.

Elements of identical function and mode of action are shown with the same reference characters in FIGS. 1-14. Only those parts of a household dishwasher that are necessary for an understanding of the invention are provided with reference characters and described.

Figure 13:
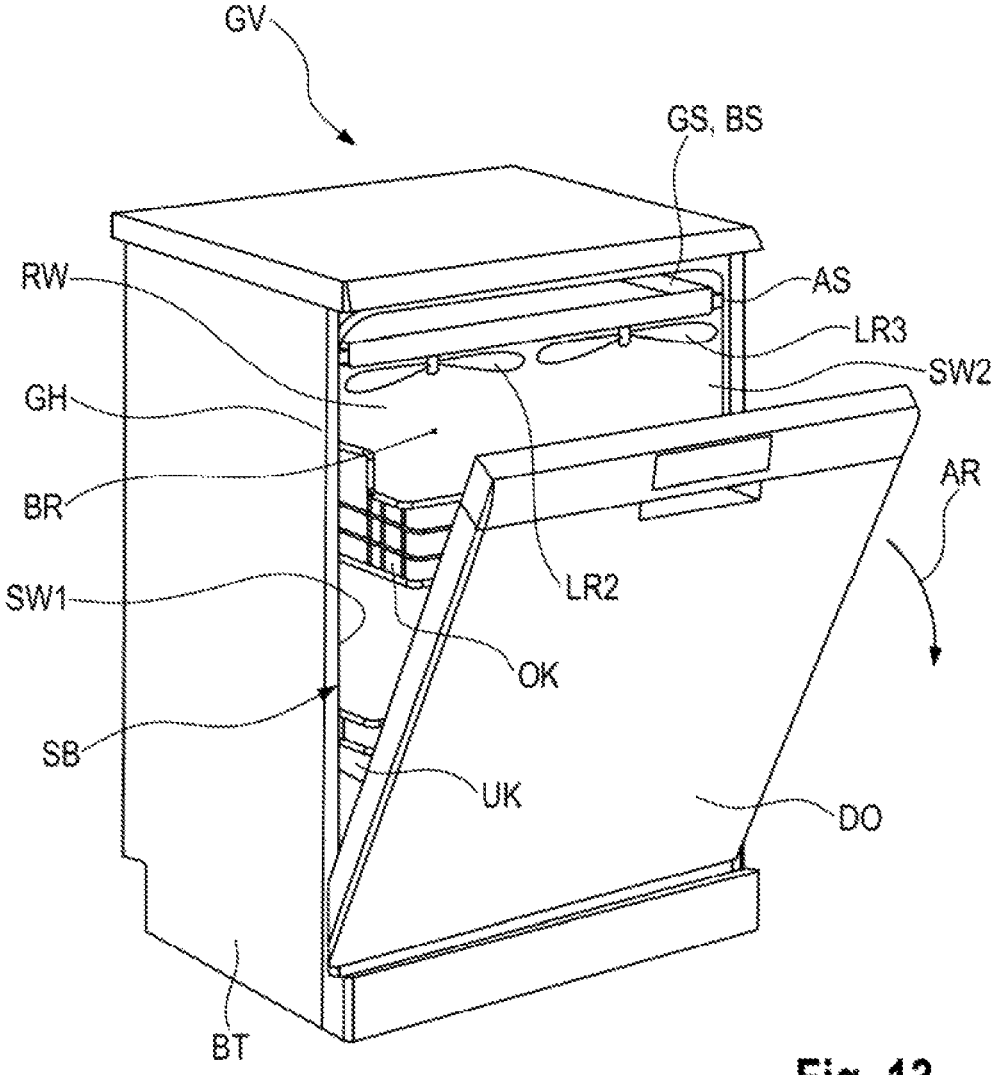
FIG. 13 shows a schematic perspective view of the basic structure of the household dishwasher in FIGS. 1, 2, in the treatment chamber of which for example multiple, in particular four, fan wheels are provided, the fan wheels being operated in a rotating manner during a blow-off operating phase immediately before and/or at the start of the drying cycle of the washing cycle of a dishwashing program to be performed, with the front door of the dishwasher closed and during a following convection phase with the front door slightly open for ventilation.
Figure 14:
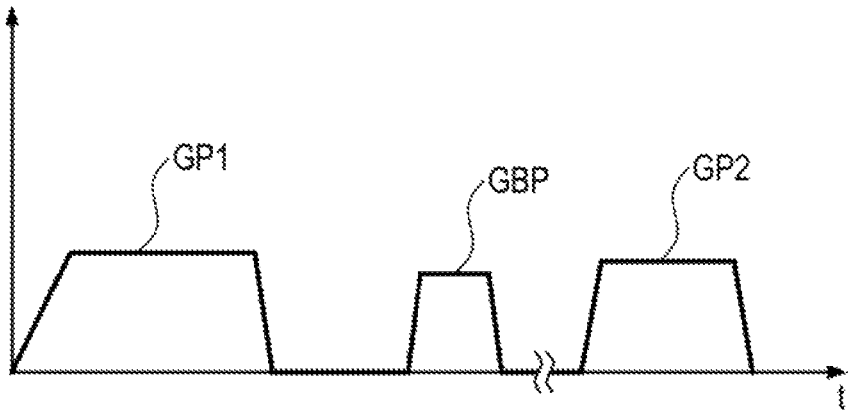
FIG. 14 shows a schematic diagram of the temporal sequence of a first dishwashing program and a later, second dishwashing program, with a ventilation/odor elimination phase being performed in the intermediate dishwashing program-free stoppage period, during which the one or more fan wheels of the inventive household dishwasher are operated in a rotating manner.

FIG. 13 shows a schematic perspective diagram viewed obliquely from the front of a first exemplary embodiment of a household dishwasher GV, which is configured according to the inventive structure and function principles. It comprises a dishwasher cavity SB with a front loading opening. When looking from the front through the loading opening into the treatment chamber or interior BR of the dishwasher cavity, the dishwasher cavity SB has an essentially rectangular layout. The dishwasher cavity is made up of a left (when viewed from the front), preferably vertical side wall SW1, a right (when viewed from the front), preferably vertical side wall SW2, a preferably vertical rear wall RW, as well as a preferably essentially horizontal top wall DW and a preferably essentially horizontal bottom wall BW (see FIG. 1). The front loading opening of the dishwasher cavity SB can be closed by a front door DO at its front. This front door DO is shown in its partially opened and therefore at an angle to the vertical position in FIG. 13. In its closed position however it is vertical. To open it, it can be pivoted forward and down in the direction of the arrow AR about a bottom horizontal axis, which extends in the transverse direction or widthwise direction of the household dishwasher essentially parallel to the lower edge of the dishwasher cavity. When the front door DO has been opened completely, it assumes an almost horizontal position in its end opening position.

When the front door DO has been moved into its end closing position, it and the walls of the dishwasher cavity enclose or delimit a treatment chamber BR. One or more loading units are accommodated in this treatment chamber BR. In the present exemplary embodiment these are in particular a lower rack UK and an upper rack OK arranged with an offset relative to the former at a heightwise distance therefrom. The respective rack UK, OK can preferably be configured such that it can be moved, in particular pulled or drawn, out of the treatment chamber in particular for loading and/or unloading. To this end a pull-out system can expediently be provided, which is not shown in FIG. 1 for the sake of clarity and is shown schematically in a highly simplified manner in FIGS. 4, 5 and marked AS for the upper rack OK. The respective rack UK, OK serves to hold items to be washed with washing liquid and then dried, for example dishes, drinking vessels (for example glasses, cups, etc.), bowls, dishes, cutlery, cooking utensils, inter alia. More delicate items to be washed, such as drinking vessels, fruit or cereal bowls, dessert bowls and other small household items are generally supported in the upper rack. At least one washing apparatus is provided to apply washing liquid SF to the treatment chamber BR. For example, as shown in FIG. 1, a rotatably supported lower spray arm US can be provided below the lower rack UK and an upper rotatably supported spray arm OS can be provided below the upper rack OK. In addition to or independently thereof other types of washing apparatus can also be arranged in the treatment chamber BR to apply washing liquid to it, for example one or more fixed or movable nozzles. These and their associated supply lines are omitted here to keep the drawing simple.

The household dishwasher GV can be configured as free-standing, or what is referred to as semi-integrated or even as a fully integrated household appliance. The one or more walls of the dishwasher cavity and/or the door can expediently be provided with one or more anti-vibration layers, sound insulation layers, reinforcing elements, force absorbers, a water inflow system, heat exchangers and other functional components on the outside. In particular the household dishwasher can have an outer housing GH partially or all the way round the outside of its dishwasher cavity SB to complete its carcass, as shown in FIG. 13. This is favorable for free-standing appliances. In the case of a built-in appliance, which is designed to be built into a recess or unit of a fitted kitchen, some or all of the outer housing can be dispensed with. The door DO can be fitted with a furniture panel or plate at the front.

The dishwasher cavity SB is preferably arranged on a base support or pedestal BT, in which one or more functional elements for the liquid application operation and/or drying operation are accommodated, for example a circulating pump CP, drain pump DP, water switch WS, controller CO1, etc.

Arranged in the treatment chamber BR, to which washing liquid is applied during the washing operation, according to the inventive structure and function principles are a number of fan wheels that can be driven in a rotating manner, in particular four fan wheels LR1-LR4 in the exemplary embodiment here, at a predefined heightwise distance above or below the upper rack OK. In the perspective diagram in FIG. 13 only the two front fan wheels LR2 and LR3 of the four fan wheels are visible. The four fan wheels LR1-LR4 are preferably supported on a framework GS. This framework GS can be provided in particular instead of a cutlery drawer BS arranged above the upper rack OK or can be formed by this. A specifically assigned touch guard, in particular a cage or protective grille, is provided for the respective fan wheel LR1-LR4, preferably on its air inlet opening and/or air outlet opening. Alternatively a shared touch guard can be provided for all the fan wheels. The touch guard is shown with a dot/dash line in FIG. 1 and marked BSU.

FIG. 1 shows a detailed schematic front view of the dishwasher cavity SB of the household dishwasher GV in FIG. 13 arranged on the base support BT. The front door DO and the outer housing GH of the household dishwasher GV are omitted here for the sake of simplicity. The view is that of a user standing in front of the household dishwasher GV and looking into the treatment chamber BR in the depthwise direction. Only the two front fan wheels LR2, LR3 are visible in the schematic front view in FIG. 1. The two fan wheels LR1, LR4 are arranged with an offset from these in the depthwise direction in the treatment chamber BR, as can be seen clearly in the schematic top view in FIG. 2.

The lower spray arm US is arranged in a freely rotatable manner below the lower rack UK and the upper spray arm OS is arranged in a freely rotatable manner below the upper rack OK. Both the lower spray arm US and the upper spray arm OS output sprayed jets of washing liquid in particular from bottom to top during their washing operation, rotating as they do so. Items being washed that are to be cleaned are therefore generally positioned upside down compared with their normal use position, in other words on their heads, in the lower rack UK and in the upper rack OK, with their hollow spaces that are soiled with food and/or beverages facing down. Larger items to be washed, for example pots, pans, large plates, large bowls, are generally placed in the lower rack UK, while smaller items to be washed, for example drinking vessels, in particular glasses, cups, dessert bowls, salad bowls, ice cream bowls, saucers and/or other small tableware items, for example jars, egg cups and/or cooking utensils, for example cooking spoons, salad servers, ice cream scoops, etc. are placed in the upper rack OS. In some instances, as in the present exemplary embodiment, the upper rack OK has a slope SE1 angled out to the side in the region of its left side wall and a slope SE2 angled out to the side in the region of its right side wall. These slopes SE1, SE2 allow the advantageous angled positioning of drinking vessels, for example glasses and/or cups, as washing liquid sprayed in the treatment chamber BR by means of at least one washing apparatus, for example the upper spray arm OS, during the washing operation, can run down from the tops of the drinking vessels more efficiently.

The items being washed, which are on their heads, in other words upside down in the upper rack OK compared with their normal use position, often have one or more depressions at the top, for example a hollow, well, groove or other cavity. Such items being washed are in particular cups or drinking glasses, which all have a circumferential edge on their base, which encloses an in particular generally flat depression. Dishes, bowls and or other tableware items and/or small tableware items, such as jars, egg cups and/or cooking utensils, for example cooking spoons, jars, etc., all have a depression in their bases, which are then at the top, when they are placed upside down in the upper rack OK.

During the performance of the one or more liquid-conducting washing sub-cycles of a dishwashing program washing liquid is distributed, in particular sprayed, in the treatment chamber BR by means of at least one washing apparatus, as in the present exemplary embodiment by the lower spray arm US and/or the upper spray arm OS. During the performance of the respective liquid-conducting washing sub-cycle therefore washing liquid can collect in the uppermost depression in the respective item being washed and remain there after the end of the washing liquid distribution operation or washing liquid application operation. Washing liquid can also remain in the uppermost depressions in items being washing which are placed in the upper rack in their normal use position. These can be salad servers, soup spoons, small bowls, espresso cups, etc.

In order to be able to let fresh water FW into the dishwasher cavity SB for the respective liquid-conducting washing sub-cycle of a dishwashing program to be performed, a water inflow system WES is provided. This is only shown schematically and in a highly simplified manner in FIG. 1 to keep the drawing simple. It can preferably comprise a water inflow valve, which can be connected to a house-side water supply line, a water inlet hose, a free flow length, a softening unit and a heat exchanger. In particular the heat exchanger can be formed by a storage container, which his filled with cold water for the drying cycle that completes the washing cycle of a dishwashing program. This storage container is in particular in heat-conducting contact with at least one wall of the dishwasher cavity SB. This keeps said wall colder than the treatment chamber BR, thereby favoring the condensing of moisture from the moist, hot air/water vapor mixture present in the treatment chamber BR after the end of the last liquid-conducting washing sub-cycle, in particular final rinse cycle, of the dishwashing program to be performed in each instance, and therefore the drying of the items being washed in the treatment chamber BR.

A desired quantity of preferably softened fresh water is let into the dishwasher cavity SB by means of the water inflow system WES for the respective liquid-conducting washing sub-cycle of a dishwashing program to be performed. It collects at a collection point that is lower than the bottom wall BW of the dishwasher cavity SB, in particular a sump SU. Said sump SU is connected in a liquid-conducting manner to a circulating pump CP by way of an intake pipe WL3 for example. The washing liquid is supplied to the lower spray arm US and the upper spray arm OS by means of the circulating pump CP by way of supply lines WL5, WL6. In some instances the circulating pump CP can be assigned a water switch or other switching apparatus, allowing selection of the supply of liquid to the supply line WL5 leading to the lower spray arm US and to the supply line WL6 leading to the upper spray arm OS. In the exemplary embodiment in FIG. 1 the water switch WS is connected downstream of the circulating pump CP (when viewed in the flow direction of the circulated liquid) by way of a connecting line WL4. In some instances the re-routing facility can also have a setting, with which washing liquid conveyed by the circulating pump CP is conveyed simultaneously to both supply lines WL5, WL6. The water switch or re-routing facility can also control, in particular establish or cancel, the flow of liquid to one or more further washing apparatuses, for example one or more fixed or movable nozzles, in particular to a top spray head or top spinning unit, by way of one or more branches on the supply lines WL5, WL6 present and/or by way of one or more supply lines specifically leaving the circulating pump and/or its assigned water switch.

After the end of the spraying operation of the respective liquid-conducting washing sub-cycle of the respective dishwashing program to be performed some or all of the washing liquid used during an end segment of this washing sub-cycle is pumped out of the treatment chamber BR, in particular the sump, of the dishwasher cavity SB by means of a drain or discharge pump DP by way of a discharge line WL2. The drain pump DP in the exemplary embodiment here is connected fluidically to the sump SU by way of an intake pipe or connecting pipe WL1.

The circulating pump CP, the drain pump DP, any water switch WS present, the sump SU and its associated liquid connection lines are preferably accommodated in the base support BT.

In order to be able to largely blow off, in particular blow down, quantities of liquid present on the tops of the items being washed that are supported in the upper rack OK, in particular liquid that has collected in upper most depressions VT in said items being washed, after the end of the liquid application operation of the last liquid-conducting washing sub-cycle, in particular the final rinse cycle, of the washing cycle of the respective dishwashing program to be performed, the multiple, in particular four, fan wheels LR1 to LR4 are driven in a rotating manner in at least one blow-off operation phase such that air from the treatment chamber is taken in by them and accelerated and air flows LS1 to LS4 from them are moved forward and downward in the treatment chamber BR, striking large blow-off regions Q1 to Q4 at the top of the upper rack OK arranged below the fan wheels LR1 to LR4. In order to be able to drive the fan wheels LR1 to LR4 in a rotating manner, drives, in particular electric drive motors AM1 to AM4, are assigned to them. In the exemplary embodiment in FIGS. 1 and 2 electric drive motors AM1 to AM4 are supported in the framework GS. They are coupled to the drive shafts W1 to W4 of the four fan wheels LR1 to LR4.

An electrical power module is provided, in particular in the base support BT, to supply electrical energy to the circulating pump CP, the drain pump DP, the water switch WS, the water inflow system WES, the electric drive motors AM1 to AM4 and/or the other electrical actuators of the household dishwasher during the course of a dishwashing program to be performed. As well as this power module a logic unit, in particular a control/regulation unit, is also provided, preferably in the base support BT, to monitor, in particular control and/or regulate, the electrical components of the household dishwasher during the course of a dishwashing program to be performed. The power module is preferably connected to the three phases of the three-phase alternating voltage supplied by a household power network. In the exemplary embodiment here in FIG. 1 the electrical energy supply and the operational control and/or regulation, in particular activation/deactivation, of the various electrical components of the household dishwasher are combined in a shared controller CO1. This controller CO1 monitors the operation in particular of the circulating pump CP, the drain pump DP, the water switch WS, the water inflow system WES and also the electric drive motors AM1 to AM4 during the course of a dishwashing program to be performed. For reasons of simplicity this is shown in FIG. 1 by associated action arrows LCP, LDP, LWS, LWES, SL1 to SL4 from the controller CO1 (see FIG. 2).

In some instances a specifically provided controller, in particular control and/or regulation unit, can be provided to monitor the operating sequence, in particular the switching on and off, of the electric drive motors AM1 to AM4. In a corresponding manner, it may be expedient in some instances to supply a specifically provided energy supply unit for the electric drive motors AM1 to AM4.

The four fan wheels LR1 to LR4 are positioned above the upper rack OK with a predefined heightwise distance therefrom such that a fan wheel LR1 to LR4 is arranged respectively above each of the four quadrants Q1 to Q4 of the holding surface of the upper rack OK, which is approximately rectangular in layout. This is clarified in FIG. 2, which shows a schematic top view of the framework GS in the dishwasher cavity SB from above. The framework GS is mounted by way of supports AS on one or more walls, here in particular the two side walls SW1, SW2, of the dishwasher cavity SB in the treatment chamber BR. In some instances it is also possible to configure the framework GS in such a manner that it can be moved out of the treatment chamber BR by means of a pull-out system, for example pull-out rails, or by means of one or more movable components, in particular rollers.

The respective fan wheel LR1 to LR4 is preferably configured as an axial fan, in particular a propeller or impeller. In the exemplary embodiment here in FIG. 1 twin-blade propellers or impellers are provided as fan wheels LR1 to LR4. The two blades of the respective propeller or impeller are arranged in a line with an approximately 180° offset. Each blade of the respective fan wheel LR1 to LR4 configured as an axial fan has a radial length L, which corresponds to approximately half the cross-sectional width of the quadrants Q1 to Q4 of the overall holding surface or overall region for supporting items to be washed in the upper rack OK which are to be blown and are assigned to the respective fan wheel LR1 to LR4. In other words the diameter D of the respective fan wheel LR1 to LR4 configured as an axial fan is approximately equal to the widthwise extension length and/or depthwise extension length of the respective quadrant Q1 to Q4. The rotation circle K1 to K4 of the twin-blade propeller or impeller of the respective axial fan wheel LR1 to LR4 is therefore delimited tangentially from the outside by the widthwise extension and/or depthwise extension of the respectively assigned quadrant Q1 to Q4. The rotation circle K1 to K4 of the respective fan wheel LR1 to LR4 is shown with a dot/dash line in FIG. 2. In a household dishwasher with expedient external dimensions of approximately 60 cm width and 60 cm depth a loading unit accommodated in its dishwasher cavity SB and able to be pulled out therefrom, for example the upper rack OK, has dimensions of around 48 cm width and 50 cm depth, therefore an overall holding surface preferably between 2000 $cm^2$ and 2500 $cm^2$. If the approximately rectangular layout of the basic holding surface of the loading unit, in particular the upper rack OK, is advantageously divided into four quadrants Q1 to Q4 of approximately equal size, and an axial fan wheel LR1 to LR4 above is assigned to all four quadrants respectively, the respective axial fan wheel is expediently dimensioned in such a manner that its respective blade has a radial extension (measured from the rotation axis of the axial fan wheel radially outward) in particular between 8 cm and 12 cm.

During its rotation operation the respective fan wheel LR1 to LR4 generates an air flow LS1 to LS4 downward onto an extensive or large blow-off region Q1 to Q4 at the top of the upper rack OK. The respectively desired, large blow-off region Q1 to Q4 preferably corresponds respectively to roughly 25% of the top overall holding surface or overall support surface of the upper rack OK. This means that just four fan wheels are sufficient to apply a flow to the overall occupied surface or loading surface of the upper rack OK. In the instance of a household dishwasher with expedient external dimensions of approximately 60 cm width and 60 cm depth and an upper rack OK with expedient dimensions of around 48 cm width and 50 cm depth, as set out above, the respective quadrant or blow-off region Q1, Q2, Q3, Q4 preferably has an area between 500 $cm^2$ and 625 $cm^2$. This is largely subject to the air flow generated by the respectively assigned fan wheel.

To this end the respective fan wheel, for example LR1 to LR4, is preferably configured in such a manner that the air flow generated by it, for example LS1 to LS4, strikes an extensive or large blow-off region, for example Q1 to Q4, at the top of the upper rack OK, corresponding in particular to between 20% and 40%, preferably approximately 25% of the uppermost overall holding surface of the upper rack OK. This means that a plurality of items being washed, which are placed on the surface for supporting items being washed in the upper rack OK and are located in the extended or large blow-off region, for example Q1 to Q4 of said fan wheel LR1 to LR4, can advantageously be struck or covered at the same time by this air flow. The even application of the same air flow to the items being washed in the respective large blow-off region, in particular in the respective quadrant, means that the items being washed as a whole are pressed evenly with the same pressure onto the surface for holding items being washed. They therefore remain standing in a stable manner. One-sided application of pressure to the respective item being washed, which could cause it to move or even tip over, is therefore largely avoided.

The framework GS has a plurality of struts for supporting the electric drive motors AM1 to AM4. The energy supply lines and/or activation lines for the electric drive motors AM1 to AM4 are also run along said struts and/or in said struts. The respective axial fan wheel LR1 to LR4 is coupled to its associated electric drive motor AM1 to AM4 by way of a drive shaft W1 to W4 respectively. It is integrated in the framework GS in a freely rotatable and flush manner or is suspended down therefrom in such a manner that it can rotate freely. The respective axial fan wheel is accommodated in the treatment chamber BR in particular in such a manner that its rotation circle K1 to K4, as described by its blades or vanes in the ventilation or fan operation is largely horizontal, in other words its rotation axis or drive shaft W1 to W4 extends essentially vertically. This allows it to be accommodated, along with its electric drive motor AM1 to AM4, taking up little height, in other words not requiring a lot of headroom, in particular between 3 and 8 cm in the treatment chamber BR.

The respective fan wheel LR1 to LR4 is expediently driven in a rotating manner in the respective blow-off operating phase, for example ABG (see FIG. 8) by the electric drive motor AM1 to AM4 assigned to it such that it blows down an air flow LS1 to LS4 with an advance speed of preferably at least 5 m/sec, in particular between 8 m/sec and 20 m/sec, preferably between around 9 m/sec and 15 m/sec, particularly preferably around 15 m/sec, which strikes the large blow-off region Q1 to Q4 assigned to the fan wheel at the top of the upper rack OK arranged below the fan wheel LR1 to LR4. It has been proven that the air flow with such an advance speed favorably has such a significant flow impetus at the location of the upper rack OK that the quantities of liquid present on the tops of the items being washed that are supported there, in particular remaining in uppermost depressions in said items being washed, can be blown down. In order to achieve such a high flow speed for the air flow of the respective fan wheel, the latter is expediently driven by its electric drive motor in such a manner that it rotates in the respective blow-off operating phase with a target speed preferably of at least 5000 revolutions/minute, in particular with target speeds between 5000 revolutions/minute and 10000 revolutions/minute, preferably between 6000 revolutions/minute and 8000 revolutions/minute.

This advantageously ensures that during the respective blow-off operating phase the air in the treatment chamber BR is pushed or accelerated downward by the respective fan wheel LR1 to LR4 rotating at speed in this manner so quickly that it outputs an air flow with a flow impetus into the treatment chamber BR onto the items being washed in the upper rack that is sufficient largely to blow off normal quantities of liquid remaining on the tops of the items being washed. An air flow generated in this manner can therefore not only blow droplets of liquid off the respective item being washed, it can also blow down a much larger quantity of liquid than the quantity of liquid in a droplet of liquid, in particular a quantity of liquid or collected liquid between 3 ml and 200 ml from the respective item being washed. In FIGS. 1 to 4 the quantity of liquid being blown off and running down from the uppermost depression VT in the respective item being washed SG is shown as WA1.

In some instances a different assignment of one or more fan wheels to one or more quadrants to be blown or other zones to be blown in the upper rack OK may be expedient. For example when looking from the front into the treatment chamber BR of the household dishwasher GV only the two left quadrants Q1 and Q2 of the upper rack OK, positioned one behind the other, may be available as zones for holding items being washed. It is then sufficient for a fan wheel LE1, LR2 only to be accommodated above these two quadrants Q1, Q2 in the treatment chamber BR. This is shown schematically in a top view of the framework GS in FIG. 3. The right half of the framework GS remains free of fan wheels and can be configured for example as a cutlery support region BA.

It may generally be expedient therefore for one or more fan wheels to be assigned to above a first region of the support surface of the loading unit, while no fan wheels are assigned to above a second region of the support surface of the loading unit. If a shared framework for the one or more fan wheels is provided above the loading unit to the blown off, a first region of the framework is therefore fitted with one or more fan wheels, while a second region remains free of fan wheels. This is then available for other use. It can be configured in particular as a cutlery holder and/or a support zone for items to be washed, in particular small items.

In some instances it may also already be sufficient for just a single fan wheel, in particular an axial fan wheel, to be accommodated above the upper rack OK in the treatment chamber BR. This is shown in a top view in FIG. 6. The rotation axis for an arm RA that can be driven in a rotating manner is provided here in the center of the approximately rectangular treatment chamber BR. The rotation circle of this arm RA is shown with a broken line and marked RK2. An electric drive motor AM is positioned at its outer end, its shaft able to drive a fan wheel, in particular an axial fan wheel, here for example a propeller PP, in a rotating manner. The rotation circle of the propeller PP is also shown and marked RK1. The two rotation circles RK1 and RK2 are dimensioned such that generally a superimposed rotation circle RK3 can be covered by the air flow generated by the fan wheel, e.g. PP, which covers almost all the support surface of the upper rack OK. The two side walls SW1 and SW2 and the rear wall RW of the dishwasher cavity SB here preferably run tangentially to the rotation circle RK3.

Contrary to this, it may in some instances be expedient to provide just one, in other words a single, fan wheel, in particular an axial fan wheel, rotatably above the center of the rectangular layout of the upper rack OK. For example with a household dishwasher with external dimensions of 60 cm width and 60 cm depth, in which the upper rack OK has dimensions of approximately 48 cm width and 50 cm depth, the single fan wheel, preferably configured as an axial fan wheel, can have a radial blade length between 20 cm and 24 cm to blow its entire support surface for items being washed with air.

Figure 4:
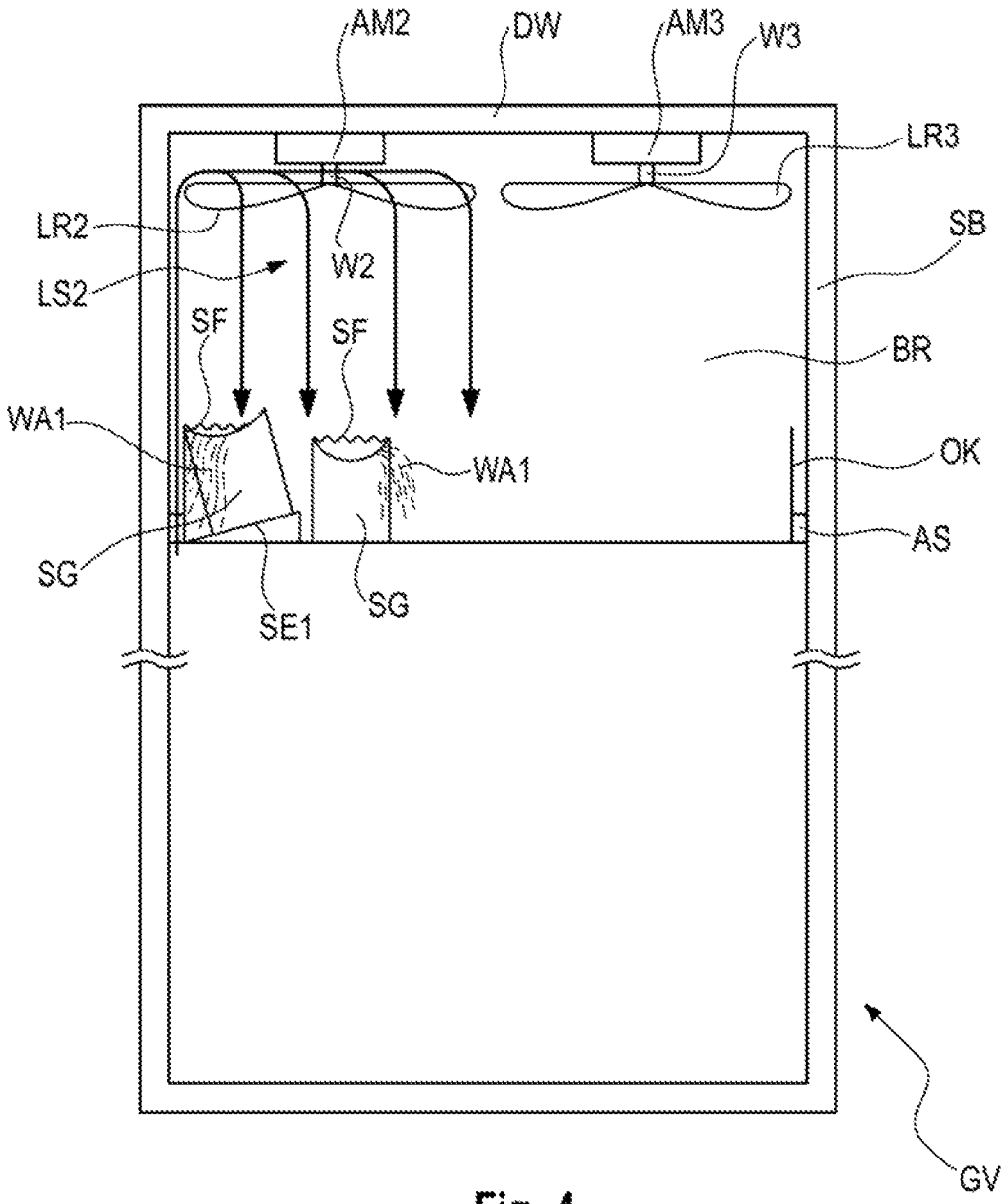
FIG. 4 shows a schematic diagram of a modified advantageous exemplary embodiment of an inventively structured household dishwasher, in which multiple fan wheels that can be driven in a rotating manner are positioned in the treatment chamber of the dishwasher cavity on its top wall together with their assigned electric drive motors.
Figure 5:
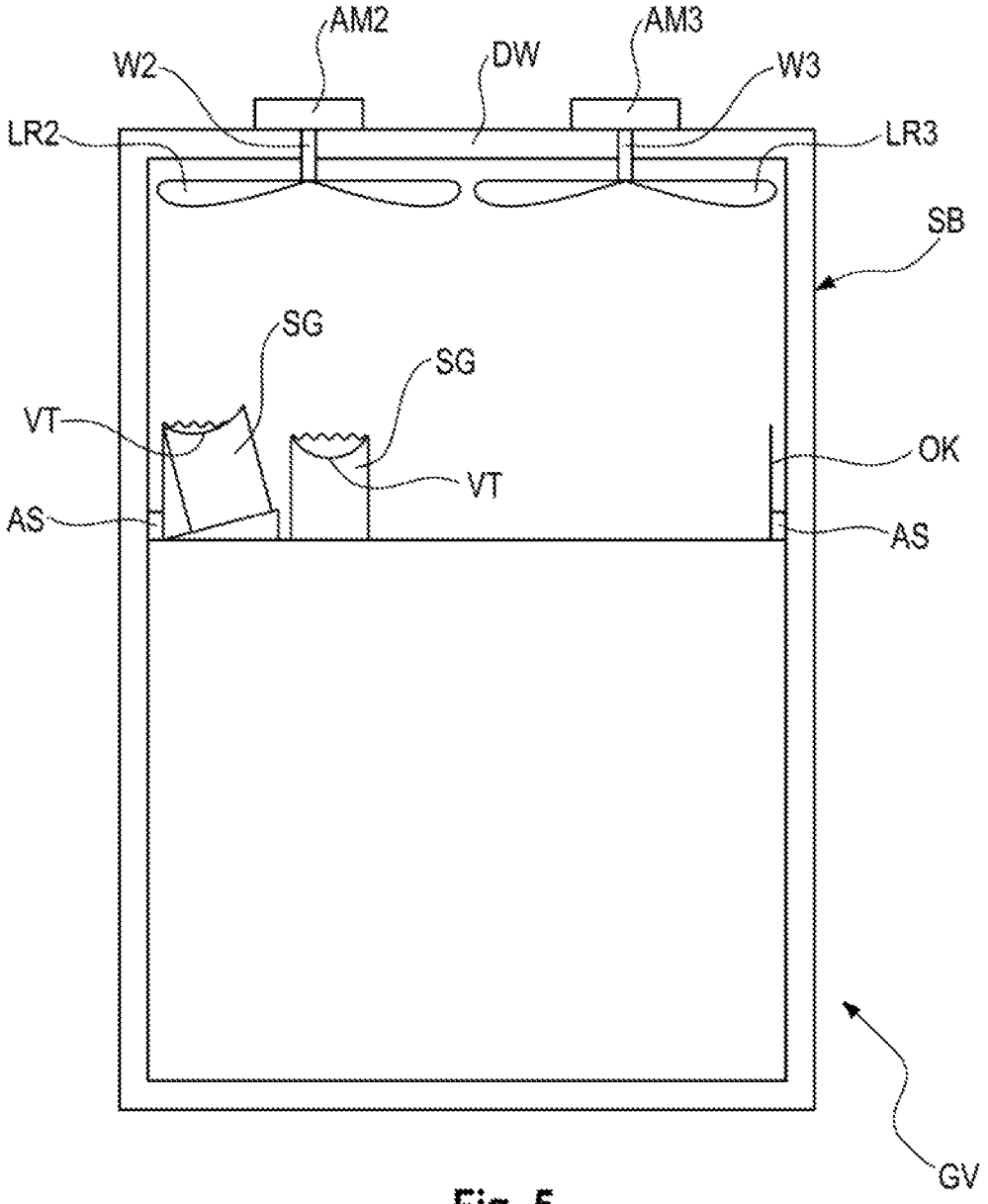
FIG. 5 shows a schematic diagram of a further modified exemplary embodiment of an inventively structured household dishwasher, in which multiple fan wheels that can be driven in a rotating manner are positioned in the treatment chamber of the dishwasher cavity on its top wall while their assigned electric drive motors are positioned on the outside of the top wall of the dishwasher cavity.
Figure 6:
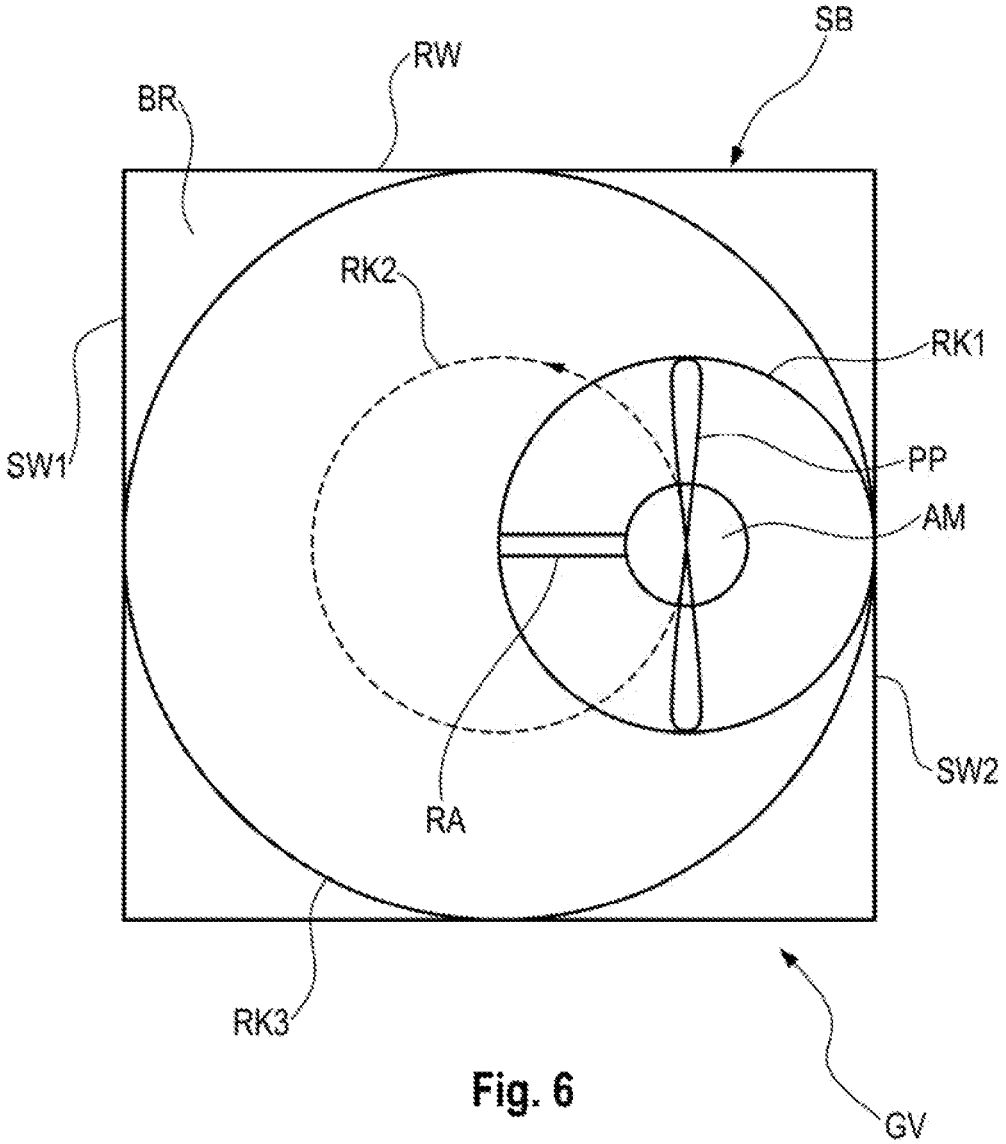
FIG. 6 shows a schematic top view of a further exemplary embodiment of an inventively configured household dishwasher, in which a single rotor that can be driven in a rotating manner is mounted on a longitudinal arm that can be driven in a rotating manner.

FIG. 4 shows a schematic front view of a further possible alternative for accommodating the one or more fan wheels, in this exemplary embodiment the four fan wheels LR1 to LR4, in the treatment chamber BR. Contrary to the exemplary embodiment in FIGS. 1, 2 and 13 the electric drive motors AM1 to AM4 of the fan wheels LR1 to LR4 are now positioned or mounted in a fixed manner directly on the top wall DW of the dishwasher cavity SB. The framework GS is omitted here.

According to a further possible modification the electric drive motors, e.g. AM1 to AM4, of the fan wheels LR1 to LR4 can in some instances be arranged, in particular positioned, externally, in other words outside the treatment chamber BR, in particular outside on the top wall DW of the dishwasher cavity SB. Their drive shafts, e.g. W1 to W4, project through openings in the top wall DW into the interior of the dishwasher cavity SB. The fan wheels LR1 to LR4 are positioned on the end segments of the drive shafts, e.g. W1 to W4, projecting into the dishwasher cavity interior or treatment chamber. The holes or passages in the top wall DW are expediently sealed by means of seals to prevent liquid escaping. This further development of the invention is shown in a schematic front view in FIG. 5.

Figure 7:
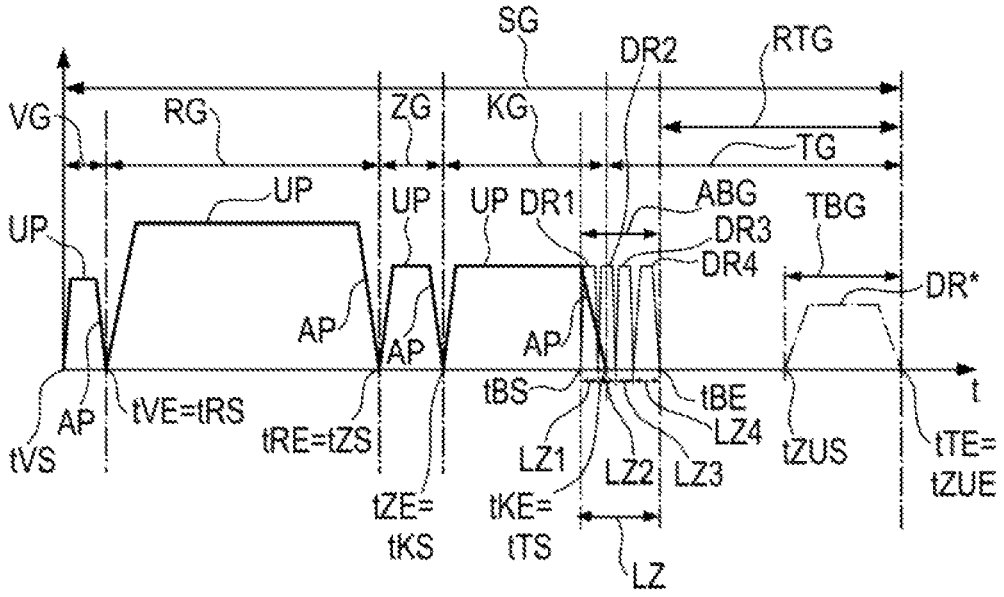
FIG. 7 shows a schematic diagram of the temporal sequence of a dishwashing program, in which a blow-off operating phase is inserted after the end of the spraying operation of the final rinse cycle, during which the one or more fan wheels are driven in a rotating manner one after the other in the treatment chamber of the dishwasher cavity, FIGS. 8, 9 each show a schematic diagram of advantageous speed profiles of the four fan wheels in the treatment chamber of the dishwasher cavity of the household dishwasher in FIG. 1, when the fan wheels are driven in a rotating manner one after the other during the blow-off operating phase.

FIG. 7 shows a schematic view of the temporal sequence of the washing cycle SG of a dishwashing program to be performed, in which a blow-off operating phase ABG is inserted after the end of the liquid application operation, in particular the washing liquid spraying operation, of the final rinse cycle KG, during which for example the four fan wheels LR1 to LR4 of the household dishwasher GV of the preceding exemplary embodiments, for example in FIGS. 1, 2, 13, 4, 5 are driven in a rotating manner one after the other. The following detailed washing sub-cycles are performed one after the other during the washing cycle SG.

First what is referred to as a pre-rinse cycle VG is performed for a predefined time period tVE–tVS. To this end a predefined quantity of clean fresh water FW is let into the treatment chamber BR of the dishwasher cavity by way of the water inflow system WES and/or from a storage container containing stored water. The circulating pump CP is switched on and conveys this fresh water to the lower spray arm US and/or the upper spray arm US. The washing liquid SF is then sprayed onto the items being washed SG in the lower rack UK and/or upper rack OK by way of their spray nozzles. The exiting spray jets with their associated flow impetus cause the lower spray arm US and/or the upper spray arm OS to rotate. This circulating operation of the circulating pump is shown as UP in FIG. 7. During an end segment of the pre-rinse cycle VG all or some of the washing liquid used for pre-rinsing is finally pumped out of the treatment chamber BR of the dishwasher cavity SB by means of the drain pump DP. This discharge operation is shown as AP in FIG. 7.

A cleaning cycle RG follows the pre-rinse cycle VG in a subsequent time period tRE–tRS. To this end fresh water and/or stored water from a storage container is supplied as required to the treatment chamber BR of the dishwasher cavity by means of the water inflow system WES, cleaning agent being added thereto. The circulating pump CP is switched on and conveys said water containing cleaning agent to the lower spray arm US and/or the upper spray arm OS. This circulating operation is again shown as UP. A heating facility is expediently switched on to activate cleaning substances, bringing the washing liquid to a required minimum temperature to activate one or more cleaning substances. This heating facility can be provided separately in the water circuit before or after the circulating pump CP. In the present exemplary embodiment the heating facility is integrated in the circulating pump CP. At the end and/or after the end of the circulating operation UP of the circulating pump CP during the cleaning cycle RG all or some of the used washing liquid is pumped out of the treatment chamber BR by means of the discharge pump DP, depending on its degree of soiling. The discharge operation is again shown as AP.

One or more intermediate rinse cycles ZG then follow using the cleanest water possible. The intermediate rinse cycle ZG serves to wash away any cleaning agent residues still adhering to the items being washed. The intermediate rinse cycle ZG here extends over a predefined time period tZE–tZS. In some instances it is not necessary to heat the washing liquid for the intermediate rinse cycle ZG by means of the heating facility. At the end and/or after the circulating operation UP of the circulating pump CP during the intermediate rinse cycle ZG all or some of the washing liquid is again removed from the treatment chamber BR of the dishwasher cavity SB by means of the discharge pump DP, depending on its degree of soiling.

The last liquid-conducting washing sub-cycle finally is the final rinse cycle KG over a predefined time period tKE–tKS. To this end water containing rinse aid is supplied to the lower spray arm US and/or the upper spray arm OS by means of the circulating pump CP and sprayed in the treatment chamber BR. In some instances the washing liquid containing rinse aid can be heated to a required minimum temperature by means of the heating facility of the circulating pump CP or a separate heating facility, in order to assist the subsequent drying cycle with residual heat drying of the items being washed. At and/or after the end of the circulating operation UP of the circulating pump CP or the spraying operation of the upper spray arm OS and/or lower spray arm US during the final rinse cycle KG as much of the washing liquid containing rinse aid as possible is pumped away by means of the discharge pump DP. This discharge operation is shown again with AP in FIG. 7.

As soon as the spraying operation of the at least one washing apparatus in the treatment chamber BR is stopped toward the end of the final rinse cycle KG, in particular as soon as the spraying operation of the upper spray arm OS and the lower spray arm US ceases, in that the circulating operation UP of the circulating pump CP has been terminated and sprayed jets of washing liquid are no longer applied to the items being washed in the upper rack OK, the blow-off operating phase ABG can start. In the exemplary embodiment therefore the blow-off operating phase ABG starts during an end segment tKE–tBS of the final rinse cycle KG. The electric drive motors AM1 to AM4 of the fan wheels LR1 to LR4 are operated in a rotating manner one after the other for this purpose. In other words the fan wheels LR1 to LR4 are driven individually in a rotating manner in a sequential sequence during specifically assigned runtime sub-segments or individual runtimes LZ1 to LZ4. For example first only the fan wheel LR1, driven by its electric drive motor AM1, generates an associated air flow LS1 in the treatment chamber BR downward onto the first quadrant Q1 of the upper rack OK during the runtime sub-segment or time period LZ1. When the drive motor AM1 of the first fan wheel LR1 has been switched off, the electric drive motor AM2 of the second fan wheel LR2 is switched on some time later and operates on its own for a time period LZ2. Only the air flow LR2 generated by it strikes the second quadrant Q2 of the upper rack OK. When the drive motor AM2 of the second fan wheel LR2 is switched off, the electric drive motor AM3 of the third fan wheel LR3 is operated on its own for an individual runtime LZ3. Only the air flow LS3 generated by the third fan wheel LR3 then strikes the third quadrant Q3 of the upper rack OK. When the drive motor AM3 of the third fan wheel LR3 has been switched off, the drive motor AM4 of the fourth fan wheel LR4 is finally switched on and operated alone for an individual runtime LZ4. All the other drive motors AM1, AM2, AM3 are switched off at this point. Only the air flow LS4 generated by the fourth fan wheel strikes the fourth quadrant Q4 of the upper rack OK. In the exemplary embodiment the blow-off operating phase ABG extends over a start time segment of the drying cycle TG. In particular an individual runtime or selectively assigned runtime sub-segment preferably between 5 sec (seconds) and 30 sec, in particular between 8 sec and 20 sec, preferably of around 15 sec is selected for the respective fan wheel during the overall duration tBE–tBS of the blow-off operating phase ABG. This gives an overall runtime duration for the blow-off operating phase ABG of preferably between 20 sec and 120 sec, in particular between 32 sec and 80 seconds, preferably around 60 sec. In some instances the overall runtime duration can preferably be 10% to 20% longer than this due to pauses or dead time between the individual runtimes of the fan wheels. This advantageously allows the blow-off operating phase ABG to be integrated or included in the normal time sequence of the washing cycle SG without significant delays. The drying cycle TG can take place for example with the aid of what is referred to as residual heat drying of the items being washed. This is because the items being washed have been heated by heated washing liquid during the washing liquid application operation of the one or more preceding washing sub-cycles, in particular during the cleaning cycle RG and/or the final rinse cycle KG. This causes the washing liquid droplets adhering to the items being washed to evaporate and be absorbed by the air in the treatment chamber. As the washing container walls are cooler than the items being washed and the air/water vapor mixture present in the treatment chamber, the moisture from the air/water vapor mixture condenses on them. Other drying systems with associated drying methods are of course also available for drying. These include in particular for example condensation drying—also using heat exchangers—on a side wall of the washing container to cool them, drying by opening a door at the end of the drying cycle, convection drying with the aid of a blower, sorption drying, etc.

Generally therefore the blow-off operating phase ABG is expediently performed before and/or during a start segment of the drying cycle TG. This ensures that quantities of liquid or liquid that has collected on the tops of the items being washed, for example in uppermost depressions, is blown away early and flows to the bottom of the dishwasher cavity. In some instances it may be expedient therefore to start the drain pump DP operating during the blow-off operating phase ABG and to pump the water thus blown off out of the dishwasher. This favors the drying of the items being washed in the upper rack OK. It is thus possible to dry even the uppermost depressions in items being washed perfectly, in particular avoiding tide marks, which would otherwise be produced by solid residues in the collected liquid. In particular the items being washed can be dried largely completely so it is no longer necessary for the user to dry the items being washed by hand afterwards or even to have to pour off the liquid that has collected in the uppermost depressions in the items being washed into the sink. In particular the user is no longer able to accidentally tip quantities of liquid remaining in depressions in the items being washed out of the items being washed after the end of the drying cycle TG, which would wet or even soil the items being washed that are supported in the lower rack UK. This significantly increases user convenience.

The blow-off operating phase ABG can be inserted easily between the end of the final rinse cycle KG and the start of the drying cycle TG, as it is of very short overall duration, in particular lasting less than 120 sec, preferably less than 90 sec.

In addition to or independently of the blow-off operating phase immediately before and/or at the start of the drying cycle it may be expedient to perform a blow-off operating phase after the liquid application, in particular spraying operation, of at least one of the liquid-conducting washing sub-cycles, for example the cleaning cycle, which is followed by a further liquid-conducting washing sub-cycle, for example an intermediate rinse cycle or final rinse cycle. Blowing quantities of liquid out of uppermost depressions in the items being washed, which are supported in the respective loading unit, in this advantageous embodiment the upper rack, after the end of the phase of the respective liquid-conducting washing sub-cycle, in which washing liquid is conveyed by means of the circulating pump to the one or more washing apparatuses, in particular spray arms, and applied by these to the items being washed in the one or more loading units, in particular the upper rack and/or lower rack, largely prevents residual quantities of used washing liquid from the present washing sub-cycle getting into the following liquid-conducting washing sub-cycle. If for example the quantities of liquid in uppermost depressions in the items being washed that are supported in the upper rack are blown off after the end of the phase of the liquid-conducting cleaning sub-cycle, in which washing liquid is conveyed to the one or more washing apparatuses, in particular spray arms, and applied by these to the items being washed in the one or more loading units, in particular the upper rack and/or lower rack, by means of the circulating pump, by means of the one or more fan wheels in a blow-off operating phase, residual water containing cleaning agent from the cleaning cycle is largely prevented from being transferred to the subsequent final rinse cycle, which could impair the action of the rinse aid there. Also the best possible elimination of residual quantities of liquid from the tops of the items being washed, in particular from their uppermost depressions, is advantageous, as it means there is not an undefined level of washing liquid in the dishwasher cavity, in particular for the next liquid-conducting washing sub-cycle Eliminating such residual quantities of water from the tops of the items being washed, in particular from their uppermost depressions, by blowing means that these residual quantities of water do not have to be additionally heated during a subsequent liquid-conducting washing sub-cycle, which is based on a defined quantity of liquid to be heated in the dishwasher cavity, thereby saving heat energy.

Figure 8:
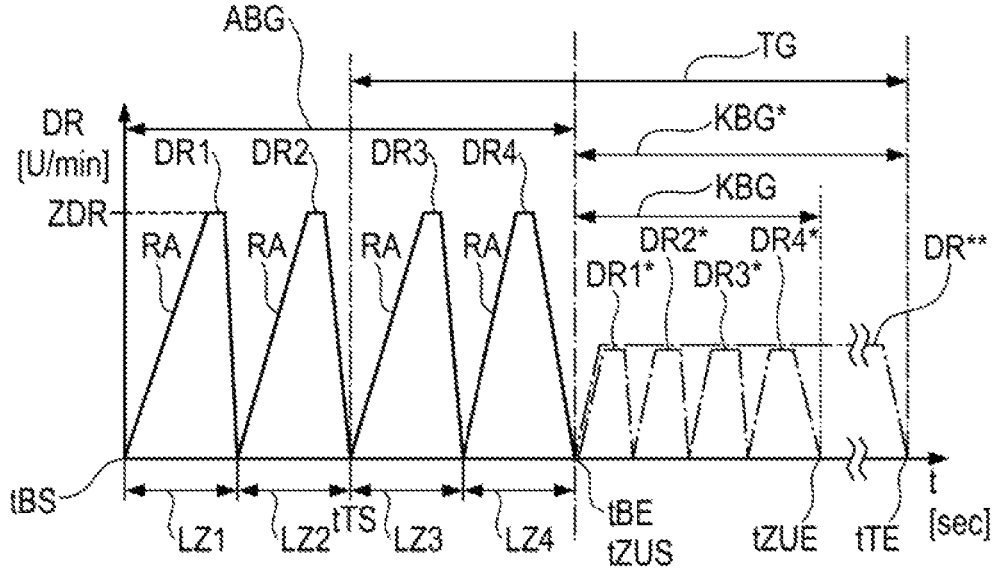

FIG. 8 shows a schematic diagram of an advantageous exemplary embodiment of a sequential sequence of speed profiles DR1 to DR4 of the four fan wheels LR1 to LR4 in the treatment chamber BR of the dishwasher cavity SB of the household dishwasher GV in FIGS. 1, 2, 13, 4, 5, when said fan wheels are driven in a rotating manner one after the other during the blow-off operating phase ABG. A runtime sub-segment LZ1 to LZ4 is assigned selectively to each of the fan wheels LR1 to LR4 or its electric drive motor AM1 to AM4 respectively over the overall duration tBE−tBS of the blow-off operating phase ABG. Each fan wheel LR1 to LR4 is driven in a rotating manner by means of the electric drive motor AM1 to AM4 assigned to it during the runtime sub-segment LZ1 to LZ4 assigned selectively to it, such that after its electric drive motor has been switched on, its speed DR (during a regulating start-up phase) increases from zero rpm to a target speed ZDR, this target speed is maintained constantly for a predefined time period, for example between 10 sec and 20 sec, and then drops back to zero rpm after its electric drive motor has been switched off. In particular the electric drive motor of the respective fan wheel and therefore the fan wheel it drives in a rotating manner follows a ramped speed profile RA from zero rpm during a short start-up phase to a target speed or maximum speed ZDR, maintains this constantly for a predefined time period, preferably of around 10-15 sec, and then drops back to zero rpm. The target speed ZDR is expediently at least 5000 revolutions per minute (abbreviated to min), in particular between 5000 revolutions/min and 10000 revolutions/min, preferably between 6000 revolutions/min and 8000 revolutions/min. The ramped speed increase allows the liquid remaining in an uppermost depression in the respective item being washed to be conveyed as a collected quantity of liquid with momentum over the outer edge of the depression. This reliably ensures that the quantity of liquid is pushed out of the depression in the respective item being washed by means of the air flow brought about by the fan wheel driven in a rotating manner in each instance.

Such selective, in other words asynchronous, rotation operating phases of the multiple fan wheels LZ1 to LZ4, which are temporally offset over the overall duration of the blow-off operating phase ABG, mean that during the respective runtime sub-segment LZ1 to LZ4 only the drive energy for the electric drive motor AM1 to AM4 of the individual fan wheel LR1 to LR4 to be driven in a rotating manner during said runtime sub-segment LZ1 to LZ4 is required, not all the drive energy for the drives for multiple or all the fan wheels at the same time. This simplifies the electric power provision or electrical energy supply for the electric drive motors of the multiple fan wheels LR1 to LR4. An individual runtime duration or a selectively assigned runtime sub-segment LZ1 t LZ4 between 5 seconds (abbreviated to sec) and 30 sec, in particular between 8 sec and 20 sec, preferably between 10 sec and 20 sec, particularly preferably of around 15 sec, is preferably selected for the respective fan wheel LR1 to LR4 during the overall duration tBE−tBS of the blow-off operating phase ABG. If, as shown here in the exemplary embodiment, an individual fan wheel LR1 to LR4 is assigned respectively to the four quadrants Q1 to Q4 of the overall support surface of the upper rack OK and these four fan wheels LR1 to LR4 are operated individually, in other words alone, one after the other, according to the above individual runtimes LZ1 to LZ4, an overall runtime duration tBE−tBS of the blow-off operating phase ABG preferably between 20 sec and 120 sec, in particular between 32 sec and 80 sec, more preferably between 40 sec and 80 sec, particularly preferably around 60 sec, results. In some instances, contrary to the above, the overall runtime duration of the blow-off operating phase can preferably be 10% to 20% longer due to pauses or dead time between the individual runtimes of the fan wheels. The temporally separated rotation operating phases of the multiple fan wheels LR1 to LR4 over the overall duration of the blow-off operating phase ABG mean that disruptive air turbulence is largely avoided in the air flows LS1 to LS4 generated by them, in particular air flow obliteration or air flow short circuits, preferably in the intermediate region between adjacent fan wheels, as the air flows generated by the fan wheels are temporally independent. In particular the noise associated with selective fan operation is quieter than when all the fan wheels LR1 to LR4 are operated in a rotating manner at the same time. If a brushless, washing water-resistant wet rotor motor in particular, as used for example in a standard discharge pump or drain pump, is provided as an electric drive motor, an electrical power input (rated power) preferably between 40 W and 80 W is advantageously sufficient for the respective fan wheel to generate an air flow with an advance speed of preferably at least 9 m/sec-15 m/sec, in particular for around 10 sec to 20 sec. If there are four fan wheels, which are assigned to the four quadrants Q1 to Q4 of the overall holding surface of the upper rack OK, only an overall electrical power input of preferably between 1600 W and 4800 W results relative to the overall duration of the blow-off operating phase ABG. The temporally selective individual, operation of the multiple fan wheels LR1 to LR4 during the blow-off operating phase ABG means that it is sufficient to provide a power module that is only designed for the electrical energy supply to the respectively active, individual electric drive motor. In the case of an electric drive motor with a predefined, for example around 80 W, rated power, this means that the electrical power module also only needs to be designed to output this rated power to the electric drive motor. The temporally separated individual operation of each of the four fan wheels LR1 to LR4 means that it is sufficient for the electrical power module only to provide the electrical rated power for the individual, actively connected electric drive motor in each instance and transfer it thereto (over the overall duration of the blow-off operating phase).

Figure 9:
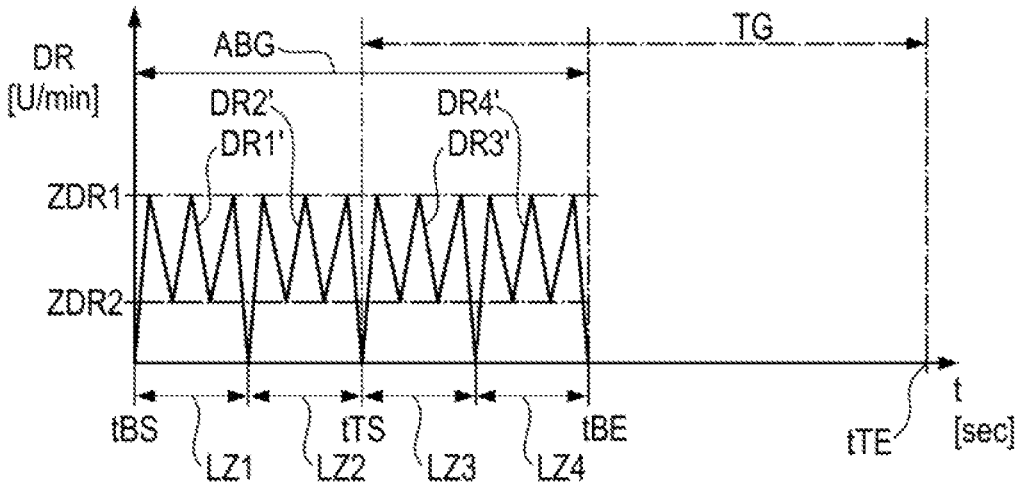

In contrast to FIG. 8, FIG. 9 shows an alternative speed profile DR1' to DR4' for the four fan wheels LR1 to LR4. The fan wheels LR1 to LR4, which are driven in a rotating manner one after the other during the blow-off operating phase ABG, have essentially the same speed pattern DR1'=DR2'=DR3'=DR4'. The respective fan wheel LR1 to LR4 is driven in a rotating manner by means of the electric drive motor AM1 to AM4 assigned to it, such that its speed DR alternates between an upper target speed value ZDR1 and a lower target speed value ZDR2 during the individual runtime LZ1 to LZ4 assigned selectively to it. This pulsing speed variation causes the flow impetus of the air flow LS1 to LS4 generated by the respective fan wheel to pulse. This dynamic variation in the flow impetus of the respective air flow LS1 to LS4 allows the liquid remaining in an uppermost depression VT in an item being washed SG to be pushed out of it and made to run down more efficiently, as during the period between the occurrence of two speed maxima or upper target speed values and associated maxima for the air flow impetuses generated the residual liquid, which could not be pushed over the edge of the depression VT in the item being washed SG, the top of which was to be blown off, with the first flow impetus maximum but remains "suspended" there, can run back from the outer edge of the depression VT to its base, collect there and then be conveyed over the edge of the depression VT, when the air flow next increases to the next maximum, in other words the second flow impetus maximum. This improves the efficiency, with which the quantity of liquid remaining in the depression in the respective item being washed can be removed therefrom. It may be sufficient in particular for the electric drive motor of the respective fan wheel to drive it in a rotating manner during its individual runtime such that its speed increases to the upper target speed value ZDR1 (from zero rpm), then drops to the lower target speed value ZDR2 and then increases back to the upper target speed value ZDR1 and then drops back to zero rpm. In general terms the respective fan wheel can be driven by its assigned electric drive motor in such a manner that its speed goes through two maxima with an intermediate minimum. The upper target speed value ZDR1 is expediently between 6000 rpm and 8000 rpm and the lower target speed value ZDR2 between 2000 rpm and 3000 rpm.

In general terms it may therefore be advantageous for the speed of the respective fan wheel provide in the treatment chamber to be varied in its runtime sub-segment assigned to it in the blow-off operating phase during its respective rotation operation. This allows the flow speed of the air flow generated by the respective fan wheel during its rotation operation to be changed over the individual runtime of said fan wheel. Such flow speed variation of the air flow generated by the respective fan wheel improves the blowing away or pushing of the quantity of liquid out of the uppermost depression in the respective item being washed.

Figure 10:
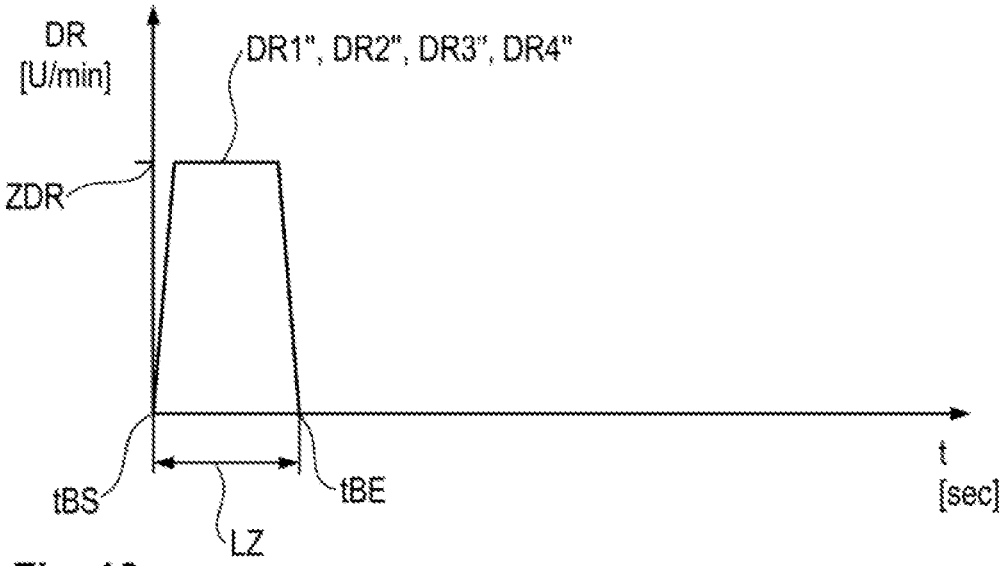
FIG. 10 shows a schematic diagram of a speed profile for each of the four fan wheels in the treatment chamber of the dishwasher cavity of the household dishwasher in FIG. 1, when all four fan wheels are driven in a rotating manner at the same time during the blow-off operating phase.

FIG. 10 shows a schematic diagram of a modified speed profile for each of the four fan wheels LR1 to LR4 when all four fan wheels are driven in a rotating manner at the same time during the blow-off operating phase ABG. In this advantageous variant all the fan wheels are operated by their electric drive motors AM1 to AM4 at the same time, in other words they are driven in a rotating manner simultaneously, over the overall duration tBE−tBS of the blow-off operating phase ABG. In the present exemplary embodiment all the fan wheels LR1 to LR4 preferably each have the same speed curve DR1"=DR2"=DR3"=DR4" over the overall duration or overall runtime LZ=tBE−tBS of the blow-off operating phase ABG. Each fan wheel LR1 to LR4 here rotates at around the same target speed ZDR. Because all four fan wheels LR1 to LR4 are driven in a rotating manner at the same time or synchronously over the overall duration LZ of the blow-off operating phase ABG, all four quadrants Q1 to Q4 of the overall holding surface of the upper rack OK are subjected to four air flows LS1 to LS4 at the same time. This advantageously shortens the overall runtime duration LZ of the blow-off operating phase ABG compared with the overall runtime duration of the blow-off operating phase when the four fan wheels are operated individually one after the other, in other words sequentially. In particular a shortened overall runtime LZ=tBE−tBE between 5 and 12 sec, preferably around 10 sec, is possible.

Alternatively it can be advantageous in some instances, when there are multiple, in particular the four, fan wheels provided in the treatment chamber, for said multiple fan wheels to be driven in a rotating manner at different target speeds from one another during their runtimes. This allows the air flows generated by the fan wheels to be given different flow speeds as further degrees of freedom. It is thus possible to adjust the speeds of the air flows in a flexible manner based on different load situations in different loading zones of the upper rack. The speed of the fan wheel assigned to a loading zone of the upper rack provided for items being washed, such as espresso cups, with smaller depressions in their bases, can therefore be selected as lower than the speed of the fan wheel assigned to a loading zone of the loading unit provided for items to be washed, for example cereal bowls, with larger depressions in their bases. The selection of different target speeds for the fan wheels can therefore be advantageous both for successive individual modes of rotation operation of the multiple fan wheels and for simultaneous rotation of all the fan wheels.

Figure 12:
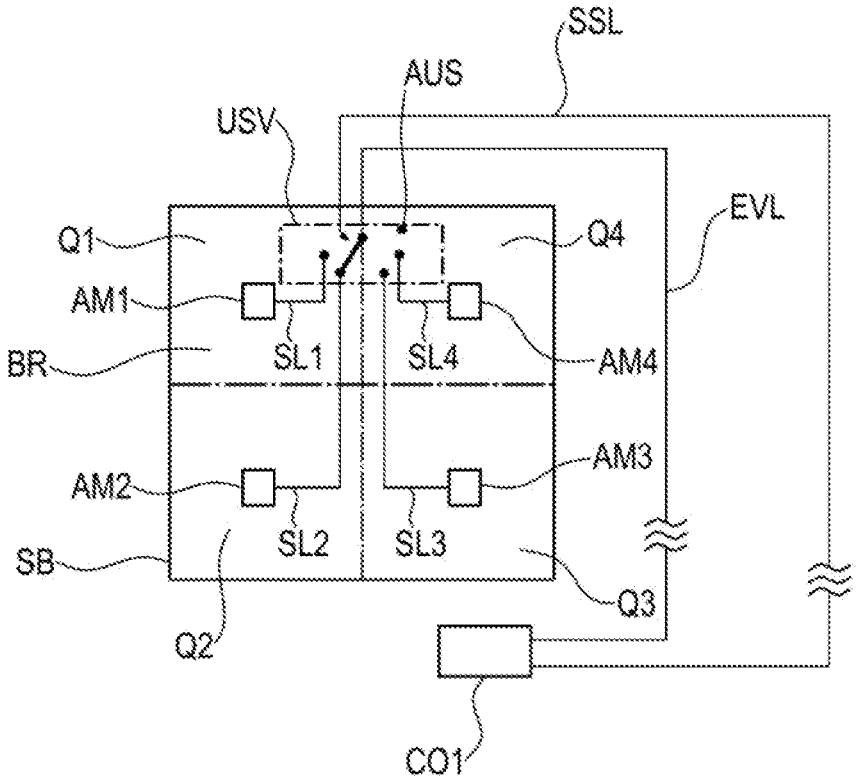
FIG. 12 shows an advantageous electrical circuit diagram for the sequential operation of the electric drive motors of four fan wheels, which are assigned to the four quadrants of a loading unit.

FIG. 12 shows an advantageous electrical circuit diagram for the sequential mode of rotation operation of the electric drive motors of the four fan wheels LR1 to LR4, which are assigned to the four quadrants Q1 to Q4 of the upper rack OK. The controller CO1 of the household dishwasher GV in the present exemplary embodiment preferably comprises an electrical power module, which provides electrical power for one or more electrical consumers, in particular actuators, of the household dishwasher as well as one or more control and/or regulation signals for activating/deactivating and/or setting the one or more electrical consumers, in particular actuators. It is advantageous for a switching apparatus USV to be provided in spatial proximity to the four electric drive motors AM1 to AM4. In the exemplary embodiment in FIG. 12 the switching apparatus USV is arranged in the treatment chamber BR of the dishwasher cavity SB, which becomes wet, along with the electric drive motors AM1 to AM4 and the associated fan wheels LR1 to LR4. The switching apparatus USV is configured such that it can switch the electrical connections SL1 to SL4 of the electric drive motors AM1 to AM4 on and off sequentially. It is sufficient here for just one electrical energy supply line to lead to the switching apparatus USV from the electrical power module of the controller CO1. The electrical energy supply line EVL and the electrical connecting lines SL1 to SL4 of the four electric drive motors AM1 to AM4 here preferably represent the three lines of a three-phase alternating current system, which is favorable in particular for brushless, washing water-resistant wet rotor motors when used as electric drive motors. The switch of the switching apparatus USV in FIG. 12 similarly symbolizes three switches for the three phase lines EVL. In order to be able to switch the respective drive motor AM1 to AM4 on and off again selectively, a control signal line from the logic facility of the controller CO1 to the switching apparatus USV is therefore sufficient. In the case of a three-phase alternating current system, in which the switching apparatus USV has three switches in the three phase lines to the three phase connecting lines of the respective electric drive motor, three control lines or a bus system are/is sufficient, represented by the control signal line SSL.

It may be favorable in particular for the framework GS to be fitted with the fan wheels LR1 to LR4 and, to drive them, the associated electric drive motors AM1 to AM4, their electrical connecting lines SL1 to SL4 and the switching apparatus USV, thereby forming a common structural unit. This facilitates incorporation or mounting of the blow-off apparatus in the treatment chamber of the respective household dishwasher. Warehousing and logistics are also simplified.

Figure 11:
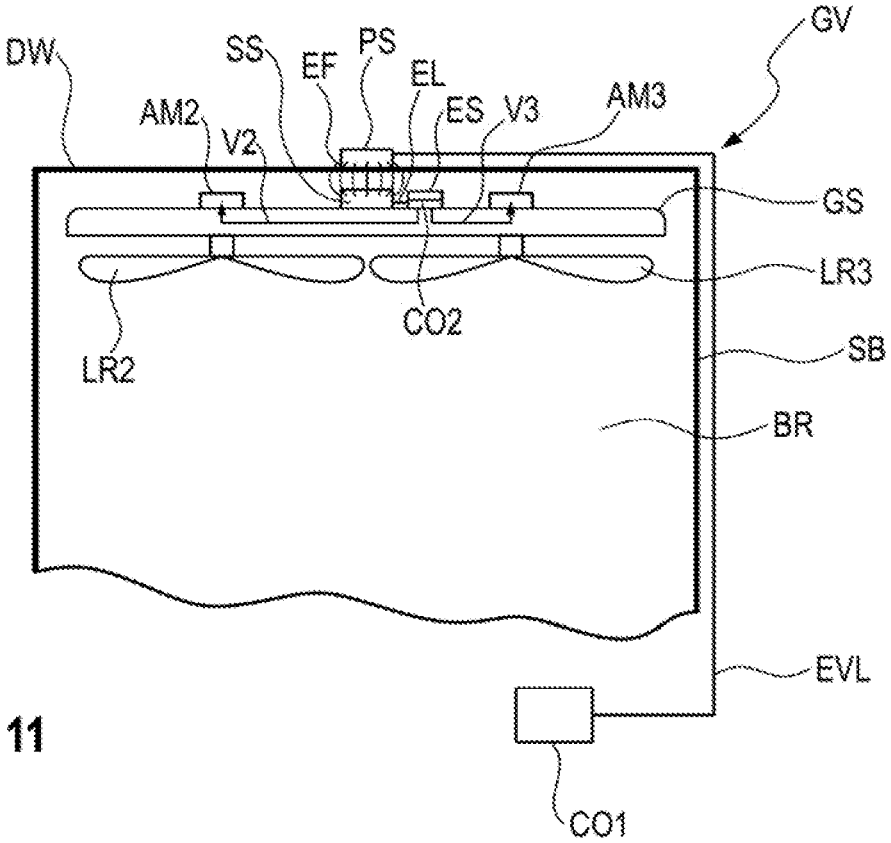
FIG. 11 shows a schematic diagram of a further advantageous exemplary embodiment of an inventively configured household dishwasher, in which the electric drive motors of the fan wheels are supplied with electrical energy by means of a rechargeable energy store.

FIG. 11 shows a schematic diagram of a further advantageous exemplary embodiment of an inventively configured household dishwasher, in which the electric drive motors AM1 to AM4 of the fan wheels LR1 to LR4 are supplied with electrical energy by means of a rechargeable energy store. The rechargeable energy store is positioned in the treatment chamber BR in FIG. 11. It is marked ES. It is positioned on the shared framework GS with the drive motors AM1 to AM4 and the fan wheels LR1 to LR4. To supply it with electrical energy, it may be expedient in particular to provide a contactless energy transfer, for example inductively EF. To this end it may be expedient for a primary coil PS to be provided outside the treatment chamber BR and the associated secondary coil SS to be provided in proximity to said primary coil PS in the treatment chamber BR. An electrical supply line EL leads from the secondary coil SS to the rechargeable energy store ES. A controller CO2 is also provided, which can also be positioned on the framework GS. The controller CO2 controls and/or regulates the energy store ES and the electric drive motors AM1 to AM4. This is shown in FIG. 11 by control and/or energy supply lines V1 to V4 leading from the controller CO2 to the electric drive motors AM1 to AM4. In particular the controller CO2 can comprise a switching apparatus, which connects the electrical energy store ES to the respective electric drive motor AM1 to AM4 for energy purposes in the desired manner. In the case of a sequential mode of rotation operation, in particular sequential activation and deactivation, of the electric drive motors, the controller CO2 connects the energy store ES sequentially to the electric drive motors AM1 to AM4.

Alternatively it may in some instances be expedient to arrange the energy store ES outside the treatment chamber BR, for example on the outer wall of the top wall DW of the dishwasher cavity SB. Instead of a contactless energy transfer it is in particular also possible to supply the energy store ES with electrical energy by way of one or more electrical lines.

Instead of a controller, which comprises a combination of a power module and a controller, in particular a control/regulation module, it may in particular also be advantageous for the electrical power module and the electrical controller to be separate components.

In some instances it may also be expedient for a controller, in particular a control and/or regulation unit, to switch on the drives of the one or more fan wheels and operate them for a predefined time period before switching them off again not only for the respective blow-off operating phase of the washing cycle of a dishwashing program to be performed but also to move air in at least one further process phase of the washing cycle and/or for at least one process step outside the washing cycle.

The controller can therefore operate the drive, in particular the electric motor, for the respective fan wheel for example after the performance of the blow-off operating phase ABG of the washing cycle SG, which is performed after the end of the liquid application operation of the last liquid-conducting sub-cycle, in particular the final rinse cycle KG, of the washing cycle SG, performed by means of the at least one washing apparatus, for example US, OS, and/or during a start segment of the following drying cycle TG, preferably in such a manner that the respective fan wheel rotates in the drying cycle during at least one convection operating phase at a speed which is lower than the speed of the respective fan wheel in the preceding blow-off operating phase. FIG. 8 shows an exemplary embodiment of this. Here, immediately after the end time point tBE of the blow-off operating phase ABG in the drying cycle TG, the electric drive motors AM1 to AM4 of the fan wheels LR1 to LR4 are again driven for a predefined time period tZUE–tZUS once or more or repeatedly one after the other, in other words sequentially, at a speed DR1*, DR2*, DR3*, DR4*, which is lower than the speed DR1 to DR4 of the respective fan wheel in the preceding blow-off operating phase ABG. This second sequential rotation operation sequence of the fan wheels serves in particular to perform a convection operating phase. During this convection operating phase the air in the treatment chamber BR is forced to circulate by the fan wheels, which are now in operation, favoring the condensing of moisture from the moist, hot air on a cold wall surface, for example on a side wall of the dishwasher cavity SB. The convection operating phase can take place here over the entire remaining runtime of the drying cycle TG. This is symbolized in FIG. 8 by the timeline KBG*. In particular however it may be advantageous only to perform this convection operating phase during a limited time period, which is shorter than the remaining runtime duration of the drying cycle, immediately after the blow-off operating cycle ABG during the drying cycle TG. This shortened convection phase is symbolized by a shorter timeline KBG in FIG. 8. This is favorable, because the moisture content and/or water vapor content in the air in the treatment chamber BR is higher at the start of the drying cycle after the blow-off operating phase ABG due to the preceding one or more washing sub-cycles including liquid application operation than at the end of the drying cycle TG. Also this temporal limiting of the convection operating phase during the drying cycle TG can limit the noise produced by the fans. The forced circulation of moist air in the treatment chamber can in particular favor the condensing of moisture from the moist, hot air and/or the water vapor on a cold wall surface, for example on a side wall of the dishwasher cavity or another condensation surface. If drying is assisted by opening the door slightly, the moist, hot air and/or water vapor from the treatment chamber BR can be blown out by means of the respective fan wheel driven in a rotating manner through an opening gap between the door and the dishwasher cavity. This is shown in FIG. 13. Here the door DO is opened slightly during the drying cycle TG. When the fan wheels LR1 to LR4 are switched on for a convection operating phase, the moist, hot air and/or the water vapor from the interior or treatment chamber BR of the dishwasher cavity SB can be forcibly blown outside. This improves the drying performance of the household dishwasher. This allows the runtime of the drying cycle to be shortened. Also surrounding kitchen units, for example a worktop above, can be better protected from swelling, as the contact time between the escaping moist, hot air/water vapor and the kitchen units can be reduced by forcing the air flow (compared with then there are no actively running fan wheels). In some instances it may be favorable for the convection operating phase only to take place at the end of the drying cycle, because then there is less hot water vapor/a lower relative air humidity in the treatment chamber than at the start of the drying cycle due to the condensation taking place during the drying time period. This residual moisture can then be blown forcibly out of the treatment chamber into its surroundings by opening the door with the fan wheels switched on, without causing problems with condensation moisture on the surrounding kitchen units.

In general terms therefore after the first sequential rotation operation sequence of the fan wheels during the blow-off operating phase a second sequential rotation operation sequence of the fan wheels is therefore provided for a convection operating phase (forced convection), for which the speed of the respective fan wheel is lower than its speed in the blow-off operating phase. The convection operating phase can extend over a sub-segment (for example KBG in FIG. 8, shown by way of example by the successive singular speed curves DR1* to DR4*) or over the entire segment KBG* of the remaining duration of the drying cycle TG, which extends from the end time point tBE of the blow-off operating phase ABG to the end time point tTE of the drying cycle TG.

Alternatively it may be expedient to drive all the fan wheels in a rotating manner at the same time during the respective convention operating phase, which follows the blow-off operating phase ABG in the drying cycle TG, at a speed, which is lower than the speed of the fan wheels during the blow-off operating phase ABG. This variant is shown in FIG. 8 by the uninterrupted speed curve DR. In the exemplary embodiment in FIG. 8 this speed curve DR extends from the end time point tBE of the blow-off operating phase ABG over the entire remaining duration KBG*=tTE−tBE of the drying cycle TG to its end time point tTE. Alternatively such air convection in the treatment chamber forced by one or more operating fan wheels can also take place for a shorter time period TBG=tZUE(=tTE)−tZUS during the remaining duration tTe−tTBE of the drying cycle TG, where TBG<tTE−tBE. This shortened time period TBG of a forced convection is shown in FIG. 7 by the speed curve DR* also shown with a dot/dash line and no interruption. It runs initially during an end segment tZUE−tZUS (=tTE) of the drying cycle TG. This variant can be favorable particularly if the front door is opened slightly by an automatic door opening system during this end segment.

In instances where forced convection is used, a speed of preferably less than 4500 revolutions/minute respectively is sufficient for the rotation operation of the respective fan wheel.

In some instances the one or more fan wheels can be driven in a rotating manner after the end of the washing cycle during a stoppage phase of the dishwasher, in which there is no dishwashing program running, if an exchange of air with ambient air is desired, for example by way of a door gap or a specifically provided air duct, to eliminate unpleasant odors in the wash chamber. This is shown in a schematic diagram in FIG. 14. An odor elimination program GBP is also provided in the time period between two successive dishwashing programs GP1 and GP2. To this end the one or more fan wheels are driven in a rotating manner by means of their associated drives, in particular their electric drive motors, and the air which is forced to move as a result is transported out of the treatment chamber by way of at least one outlet opening in the dishwasher cavity and/or the front door and in some instances blown by a downstream odor elimination apparatus, which filters out or neutralizes odors that are unpleasant to humans.

The invention claimed is:

1. A household dishwasher, comprising:

a dishwasher cavity defining a treatment chamber;

a loading unit accommodated in the treatment chamber for holding items to be washed;

a washing apparatus configured to apply washing liquid to the treatment chamber;

a controller; and two or more fan wheels mounted to a framework positioned adjacent to an upper, interior surface of the treatment chamber and above the loading unit for rotation in a blow-off operating phase such that the two or more fan wheels draw in air from the treatment chamber, accelerate and move the air forward and downward as an air flow in the treatment chamber, with the air flow striking a blow-off region at a top of the loading unit and blowing off washing liquid from atop the items being washed, wherein the two or more fan wheels are configured to be driven in a rotating manner in the blow-off operating phase individually one after the other during runtime sub-segments assigned selectively to the two or more fan wheels by the controller that is configured to control the runtime sub-segments.

2. The household dishwasher of claim 1, wherein the loading unit includes an upper rack, the two or more fan wheels being provided in the treatment chamber above the upper rack.

3. The household dishwasher of claim 1, wherein the blow-off region at the top of the loading unit is between 10% and 100% of an overall top holding surface of the loading unit.

4. The household dishwasher of claim 1, wherein the controller is configured to control the blow-off operating phase and a washing cycle comprising a drying cycle and a liquid-conducting washing sub-cycle, and wherein the blow-off operating phase is configured to be performed after the washing apparatus has applied the washing liquid to the treatment chamber in the liquid-conducting washing sub-cycle of the washing cycle of a dishwashing program to be performed, wherein the blow-off operating phase is configured to be performed during an end segment of the liquid-conducting washing sub-cycle or during a start segment of the drying cycle terminating the washing cycle.

5. The household dishwasher of claim 1, further comprising a plurality of electric drive motors configured to drive the two or more fan wheels in the blow-off operating phase such that the air flow generated by the two or more fan wheels strikes the blow-off region with an advance speed of between 5 m/sec and 20 m/sec.

6. The household dishwasher of claim 1, further comprising a drive, which includes a plurality of electric drive motors, configured to rotate the two or more fan wheels in the blow-off operating phase with a target speed between 5000 RPM and 10000 RPM.

7. The household dishwasher of claim 1, wherein the two or more fan wheels are configured as axial fans.

8. The household dishwasher of claim 1, wherein the two or more fan wheels are configured as axial fans having multiple blades, each of the blades having a radial length, which corresponds to half a cross-sectional width of the blow-off region.

9. The household dishwasher of claim 8, wherein the axial fans each have two blades arranged in 180° offset relationship.

10. The household dishwasher of claim 1, wherein each fan wheel of the two or more fan wheels is arranged above a different quadrant of the four quadrants of a rectangular layout of a holding surface of the loading unit.

11. The household dishwasher of claim 1, further comprising a plurality of electric motors operably connected to the two or more fan wheels as a drive.

12. The household dishwasher of claim 11, wherein the controller is configured to switch on the drive of the two or more fan wheels and to operate the two or more fan wheels for a predefined time period for the blow-off operating phase of a washing cycle of a dishwashing program to be performed and to move air in a further process phase of the washing cycle and/or for a process step outside the washing cycle.

13. The household dishwasher of claim 1, further comprising a touch guard provided for the two or more fan wheels on an air inlet opening and/or air outlet opening of the two or more fan wheels.

14. The household dishwasher of claim 1, wherein the two or more fan wheels are axial fans that each comprise one or more blades, wherein the one or more blades are arranged parallel to the upper, interior surface of the treatment chamber.

* * * * *